US012710202B2

(12) United States Patent
Hill

(10) Patent No.: US 12,710,202 B2
(45) Date of Patent: Aug. 18, 2026

(54) INTEGRATED HEATING SYSTEM USING A STIRLING HEAT PUMP

(71) Applicant: Trane International Inc, Davidson, NC (US)

(72) Inventor: Donald Lee Hill, Cornelius, NC (US)

(73) Assignee: Trane International Inc, Davidson, NC (US)

( * ) Notice: Subject to any disclaimer, the term of this patent is extended or adjusted under 35 U.S.C. 154(b) by 295 days.

(21) Appl. No.: 18/356,393

(22) Filed: Jul. 21, 2023

(65) Prior Publication Data

US 2025/0027688 A1 Jan. 23, 2025

(51) Int. Cl.
*F25B 9/14* (2006.01)

(52) U.S. Cl.
CPC ..... *F25B 9/14* (2013.01)

(58) Field of Classification Search
CPC .. F24D 2200/12; F24D 2200/123; F24D 3/08; F24D 3/18; F24D 5/12; F25B 13/00; F25B 2339/047; F25B 30/02; F25B 9/14
See application file for complete search history.

(56) References Cited

U.S. PATENT DOCUMENTS 4,189,929 A * 2/1980 Russell ..... F25B 49/02 62/176.5
4,794,752 A 1/1989 Redderson
4,959,970 A 10/1990 Meckler
4,996,841 A 3/1991 Meijer et al.
5,074,114 A 12/1991 Meijer et al.
5,088,284 A 2/1992 Momose
6,109,339 A * 8/2000 Talbert ..... F24F 5/0096 454/243
6,151,896 A 11/2000 Veringa et al.
7,810,330 B1 10/2010 Weaver et al.
7,877,999 B2 2/2011 Nuel et al.
(Continued)

FOREIGN PATENT DOCUMENTS

CN 102997417 A 3/2013
EP 2 454 536 A1 5/2012
GB 2 174 799 A 11/1986

OTHER PUBLICATIONS

Qiu, S. & Solomon, L. Free-Piston Stirling Engine Generators. Published Nov. 5, 2018. 25 pages. Retrieved from the Internet <DOI:10.5772/intechopen.79413>.

*Primary Examiner* — Filip Zec
(74) *Attorney, Agent, or Firm* — Womble Bond Dickinson (US) LLP

(57) ABSTRACT

Examples of the present disclosure relate to systems and methods for providing hot water for a hot water heater and heating capacity for a climate control system by utilizing a Stirling heat pump system. The Stirling heat pump may be partially integrated into an indoor unit of the climate control system and a hot water heater. An additional indoor heat exchanger may receive heating fluid from the Stirling heat pump system to provide heating capacity in addition to another indoor heat exchanger of the climate control system. Further, the heating fluid circuit of the Stirling heat pump system may be partially integrated into a hot water tank for heating water. A controller may direct the flow of heating fluid from the Stirling heat pump to the hot water tank and/or the climate control system based on a request for heating.

19 Claims, 9 Drawing Sheets

(56) References Cited

U.S. PATENT DOCUMENTS

| | | | | |
|---|---|---|---|---|
| 7,937,955 | B2 | 5/2011 | Tsao | |
| 8,224,495 | B2 | 7/2012 | Weaver et al. | |
| 8,435,103 | B2 | 5/2013 | Centofante | |
| 8,539,764 | B2 | 9/2013 | Howard | |
| 8,539,771 | B2 | 9/2013 | Nuel et al. | |
| 9,759,456 | B2 * | 9/2017 | Hancock | F25B 13/00 |
| 9,790,891 | B2 | 10/2017 | Moore, II | |
| 10,012,393 | B2 | 7/2018 | Deivasigamani et al. | |
| 10,100,778 | B2 | 10/2018 | Nuel et al. | |
| 10,317,261 | B2 * | 6/2019 | Noboa | G01F 1/363 |
| 10,345,004 | B1 | 7/2019 | Hern et al. | |
| 10,527,321 | B2 * | 1/2020 | Warren | F25B 49/022 |
| 10,696,134 | B2 | 6/2020 | Cosgrove et al. | |
| 10,954,886 | B2 | 3/2021 | Nuel et al. | |
| 11,353,227 | B2 * | 6/2022 | Stamenkovic | F25B 47/025 |
| 11,486,592 | B2 * | 11/2022 | McCarty | F24F 3/1423 |
| 2005/0016184 | A1 * | 1/2005 | Zhang | F25D 11/00 62/434 |
| 2009/0221224 | A1 | 9/2009 | Centofante | |
| 2010/0107633 | A1 | 5/2010 | Taso | |
| 2012/0227926 | A1 * | 9/2012 | Field | F24S 10/95 165/157 |
| 2013/0104574 | A1 | 5/2013 | Dempsey et al. | |
| 2014/0123689 | A1 | 5/2014 | Ellis et al. | |
| 2015/0276272 | A1 * | 10/2015 | Nakano | F25B 9/14 62/6 |
| 2017/0356681 | A1 * | 12/2017 | Douven | F25B 41/20 |
| 2018/0347406 | A1 | 12/2018 | Friesth | |
| 2019/0055932 | A1 * | 2/2019 | Joffroy | F04B 35/002 |
| 2020/0224919 | A1 * | 7/2020 | Clayton | F24F 5/001 |
| 2021/0108804 | A1 * | 4/2021 | Joffroy | F04B 35/01 |
| 2021/0199091 | A1 | 7/2021 | Hopkins et al. | |
| 2022/0373200 | A1 * | 11/2022 | Bonner | F24F 13/30 |
| 2022/0390148 | A1 | 12/2022 | Taras et al. | |
| 2023/0400227 | A1 * | 12/2023 | Dobkin | F25B 7/00 |
| 2024/0219076 | A1 * | 7/2024 | Terry | F25B 9/14 |

* cited by examiner

INTEGRATED HEATING SYSTEM USING A STIRLING HEAT PUMP

TECHNOLOGICAL FIELD

The present disclosure relates generally to systems and methods for providing hot water and/or conditioned air heating capacity utilizing a Stirling heat pump.

BACKGROUND

Various climate control systems exist, and several of these systems are able to provide both heating and cooling. These systems typically use refrigerant circuits to transport thermal energy between components of the system using thermal gradients. Each of these designs offer various advantages, and typically provide for conditioning over a given temperature range. A common form of these systems, often referred to as a heat pump, uses a reversible refrigerant circuit that moves thermal energy between two heat exchanger coils to provide heating and/or cooling as desired.

The refrigerant circuits of each of these systems are driven by a compressor that pulls in refrigerant fluid from an evaporator coil and compresses the refrigerant fluid to discharge the refrigerant fluid to a condenser coil. The evaporator coil absorbs thermal energy into the system while the condenser coil discharges thermal energy to provide heating as desired. Operating in very low temperature environments, however, can cause the refrigerant circuit to operate less efficiently because the temperature difference between the outdoor environment and the refrigerant fluid in the evaporator coil is reduced. This makes it difficult for the refrigerant fluid to absorb sufficient thermal energy from the outdoor environment to meet the desired heating demand.

Some systems seek to improve heating performance by utilizing electrical heating elements. These electrical heating elements, however, may have poorer overall efficiency, lead to increased energy costs, and/or suffer from other problems. As a result, there exists an opportunity for an energy efficient approach to increase the operating performance of heating systems for lower temperature environments.

BRIEF SUMMARY

The present disclosure includes, without limitation, the following examples.

Some example implementations include a heating system for heating both conditioned air and water, the heating system comprising: a Stirling heat pump configured to provide heating to a heating fluid, the Stirling heat pump including a hot side chamber and a cold side chamber, the hot side chamber and the cold side chamber fluidly connected by a working fluid; and a heating fluid circuit thermally coupled to the hot side chamber and configured to circulate the heating fluid, the heating fluid circuit including: a circulation pump coupled to the heating fluid circuit and configured to circulate the heating fluid through the heating fluid circuit; an air conditioning heating coil, the air conditioning heating coil configured to heat the conditioned air circulated through an air handling unit; a hot water heating coil, the hot water heating coil configured to heat the water within a hot water heater; and a control valve coupled to the heating fluid circuit, the control valve configured to adjust a flow of the heating fluid between the air conditioning heating coil and the hot water heating coil.

Further example implementations may include an air handler unit, the air handler unit including: a primary indoor coil, the primary indoor coil configured to exchange thermal energy between a refrigerant fluid and a conditioned air; a secondary air conditioning heating coil, the secondary air conditioning heating coil configured to exchange thermal energy between a heating fluid and the conditioned air, wherein the heating fluid is routed through a heating fluid circuit that includes a control valve, wherein the heating fluid circuit is thermally coupled to a hot side chamber of a Stirling heat pump, the Stirling heat pump including the hot side chamber, a cold side chamber, and a working fluid fluidly connected between the hot side chamber and the cold side chamber; a fan configured to circulate the conditioned air over the primary indoor coil and the secondary air conditioning heating coil to condition the conditioned air; and control circuitry communicatively coupled to the control valve and configured to: direct the heating fluid through the secondary air conditioning heating coil in response to a request for heating.

Further example implementations may include a method of heating both conditioned air and water using a heating fluid, the method including: circulating the heating fluid through a heating fluid circuit; heating the heating fluid; routing the heating fluid to an air conditioning heating coil, the air conditioning heating coil configured to heat the conditioned air circulated through an air handling unit; routing the heating fluid to a hot water heating coil, the hot water heating coil configured to heat the water within a hot water heater; and adjusting a flow of the heating fluid between the air conditioning heating coil and the hot water heating coil.

These and other features, aspects, and advantages of the disclosure will be apparent from a reading of the following detailed description together with the accompanying drawings, which are briefly described below. The disclosure includes any combination of two, three, four, or more of the above-noted embodiments, examples, or implementations as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects, embodiments, examples, or implementations, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

Figure 5:
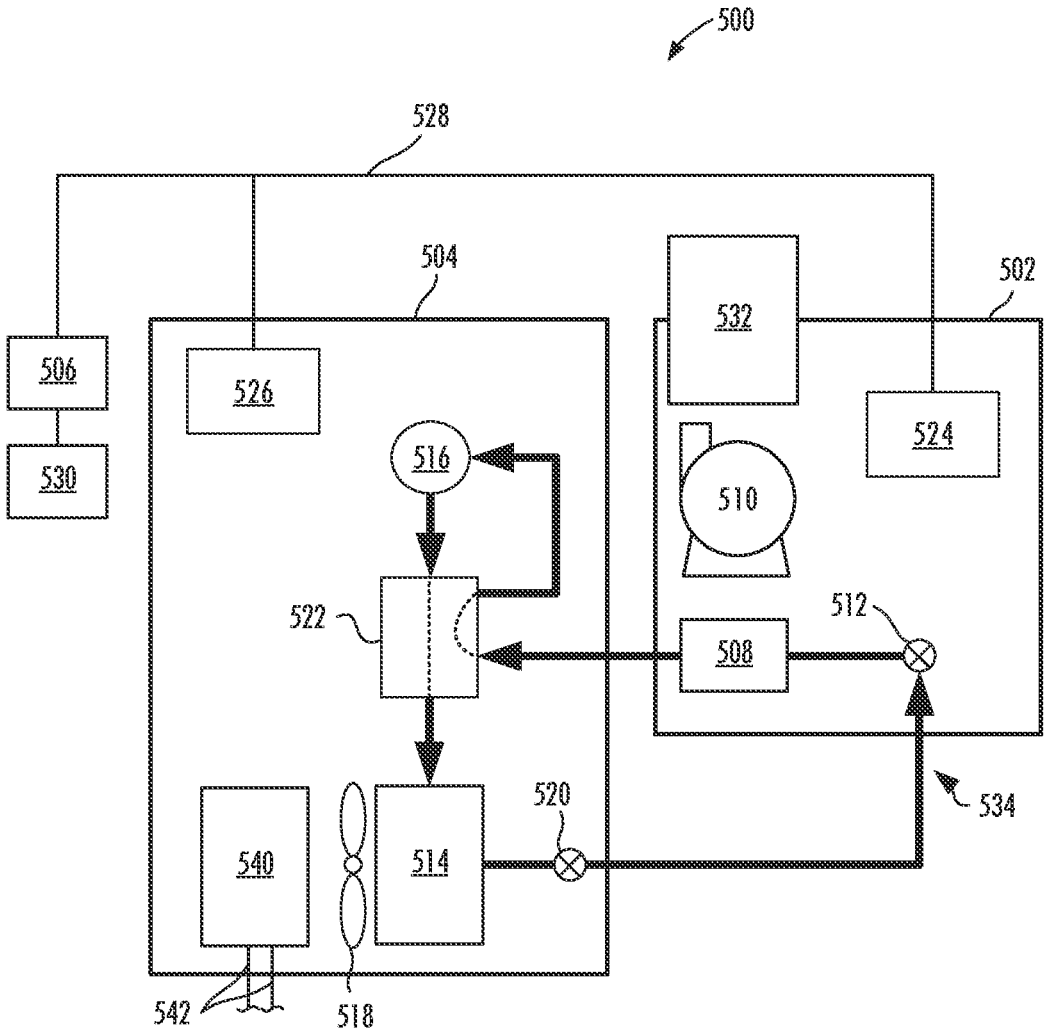
Figure 6:
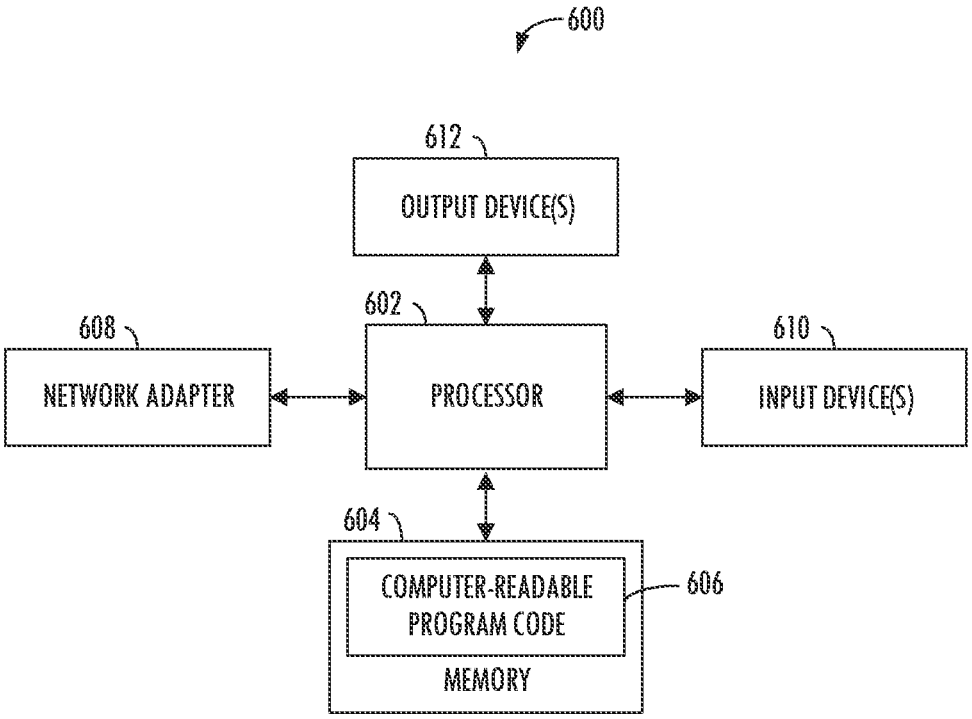

FIGS. 4A, 4B, 4C, 4D, 4E, 4F, and 4G illustrate flowcharts for controlling a heating system, according to some example implementations of the present disclosure;

FIG. 5 illustrates a schematic diagram of a climate control system, according to some example implementations of the present disclosure; and FIG. 6 illustrates control circuitry, according to some example implementations of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the embodiments, examples, or implementations set forth herein; rather, these embodiments, examples, or implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments, examples, or implementations of the described disclosure in the installed configuration (e.g., in an operational configuration). It is understood that such terms are not used in any absolute sense.

Example implementations of the present disclosure relate to systems and methods utilizing a Stirling heat pump to provide conditioning, e.g., heating, for a climate control system. These examples further include systems and methods for providing hot water for a hot water heater and/or heating capacity for a climate control system by integrating a heating fluid circuit of a Stirling heat pump system with the hot water heater and/or the climate control system. The Stirling heat pump may be integrated, at least in part, into an indoor unit of the climate control system by using an additional indoor heat exchanger coupled to the Stirling heat pump. The additional indoor heat exchanger may receive heating fluid from the Stirling heat pump to provide heating capacity in addition to, or instead of, the primary indoor heat exchanger of the climate control system. Further, the heating fluid circuit of the Stirling heat pump system may be integrated, at least in part, into a hot water heater to heat the water therein. Further example implementations of the present disclosure relate to systems and methods for directing the heating fluid from the Stirling heat pump to the hot water heater and/or the climate control system based, at least in part, on a request for heating, e.g., a request for hot water or a request for heating capacity. In some examples, the Stirling heat pump system may prioritize heating hot water in the hot water heater over providing heating capacity to the climate control system, or vice versa. This priority may be based at least in part on one or more conditions, e.g., outdoor ambient temperature, time of day, or the like.

Some advantages to such systems may include, at least in part, improved climate control system heating performance at low outdoor ambient temperatures due to the high efficiency of Stirling heat pumps to remove thermal energy from low temperature medium, e.g., cold outdoor ambient air or the like. For example, in heating mode as the outdoor ambient temperature decreases, e.g., to 20° F. to −25° F. or less, a Stirling heat pump may maintain a higher heating capacity compared to refrigerant based evaporator heat pumps. Moreover, in cooling mode a Stirling heat pump may be able to reach cryogenic temperature ranges, e.g., down to −170° C.

Some other advantages may also include overall reduced heating system costs because the Stirling heat pump system may replace less efficient electrical heating elements and/or gas burners in hot water heaters and/or climate control systems. Further, in some examples, the Stirling heat pump system, as will be described in further detail below, may be configured to replace various different pieces of home heating equipment, thereby removing the need for expensive redundant costs, e.g., tankless water heaters, gas fired furnaces, electrical heating elements, or the like.

Another advantage for the Stirling heat pump system described herein is lower maintenance cost because the Stirling heat pump does not require an additional lubrication system, at least in part, because the working fluids utilized by the Stirling heat pump typically do not experience metallurgical reactions with metal components. Furthermore, the working fluids utilized by the Stirling heat pump, as described herein, have a low global warming potential (GWP). Moreover, Stirling heat pumps also generally produce lower noise levels compared to some refrigerant compressors.

Before discussing the details of the various different processes for providing hot water and/or heating capacity with the heating systems described herein, an overview of example heating systems, and components thereof, are discussed below with reference to FIG. 1.

Figure 1:
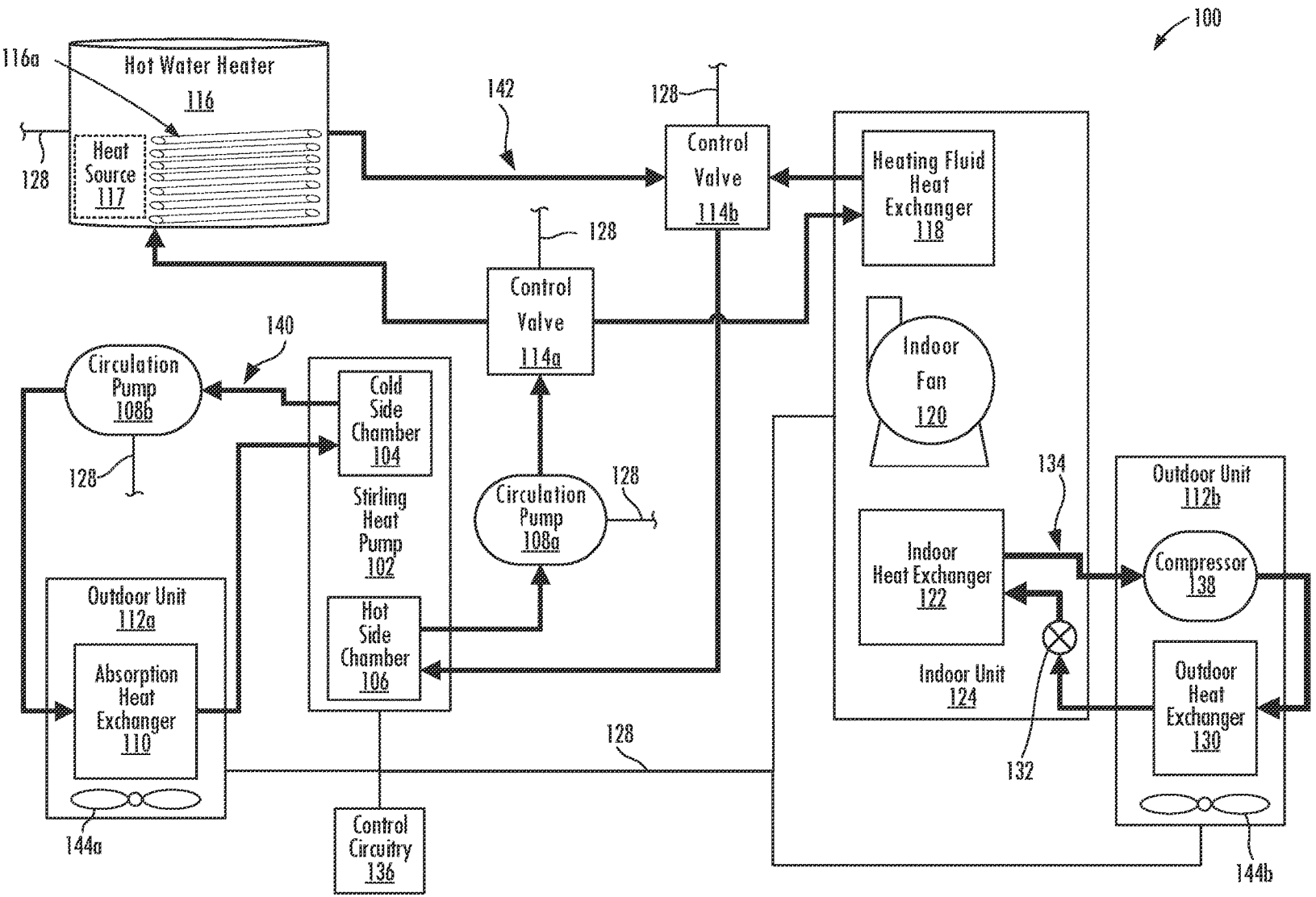
FIG. 1 illustrates a schematic diagram of a heating system, according to some example implementations of the present disclosure.

FIG. 1 shows an example heating system 100 configured with a Stirling heat pump 102 for providing, at least in part, hot water and/or conditioned air heating capacity, e.g., to a home, business, or the like. The heating system 100, as shown, generally comprises a Stirling heat pump 102, circulation pumps 108*a*-108*b*, outdoor units 112*a*-112*b*, indoor unit 124, control valves 114*a*-114*b*, a hot water heater 116, a communication bus 128, and a control circuitry 136.

Further, as shown in the depicted example, a cold side chamber 104 of the Stirling heat pump 102 may be fluidly coupled, at least in part, to a heat absorption circuit 140. Moreover, as shown, a hot side chamber 106 of the Stirling heat pump 102 may be fluidly coupled, at least in part, to a heating fluid circuit 142*a* comprising a fluid connection to the hot water heater 116 and a heating fluid heat exchanger 118 of the indoor unit 124. Furthermore, as shown, the indoor unit 124 and, at least in part, the outdoor unit 112*b* may be fluidly coupled via a refrigerant fluid circuit 134 to form a heat pump of a climate control system as will be described in further detail below with respect a climate control system 500 and FIG. 5. In some examples, the heating system 100 may include in whole, or in part, the Stirling heat pump system 200 described below with respect to FIG. 2. In some examples, the heating system 100 may include in whole, or in part, the climate control system 500 described below with respect to FIG. 5.

The Stirling heat pump 102, as shown, may include a cold side chamber 104 and a hot side chamber 106. As shown, the Stirling heat pump 102 may be configured, at least in part, to provide thermal energy, e.g., heating, from a heat absorption circuit 140 to a heating fluid of the heating fluid circuit 142*a*. Further, the cold side chamber 104 and the hot side chamber 106 may be fluidly connected, at least in part, by a working fluid circuit that includes a working fluid flowing between the cold side chamber 104 and the hot side chamber 106 in order to transfer thermal energy from the cold side chamber 104 toward the hot side chamber 106.

Moreover, the Stirling heat pump 102 may be configured to pump the working fluid between the cold side chamber 104 and the hot side chamber 106 to facilitate the transfer of thermal energy between each side chamber. In some examples, the working fluid circuit within the Stirling heat pump 102 may be a closed loop circuit that does not exchange a working fluid with another fluid circuit, e.g., the heat absorption circuit 140 and/or the heating fluid circuit 142*a*. In some examples, the working fluid of the Stirling heat pump 102 may be one or more of water, ethylene glycol, hydrogen, nitrogen, helium, a compound thereof, a combination or mixture thereof, or the like for at least absorbing thermal energy from the cold side chamber 104 and rejecting thermal energy to the hot side chamber 106. The working fluid of the Stirling heat pump 102 may be the same, substantially similar to, or different from a working fluid of another fluid circuit, e.g., the heat absorption circuit 140, the heating fluid circuit 142*a*, or the like.

In order to walkthrough the general operation of a Stirling heat pump, the Stirling heat pump 102 will now be described in further detail in the context of an example Stirling heat pump system 200 illustrated in FIG. 2.

Figure 2:
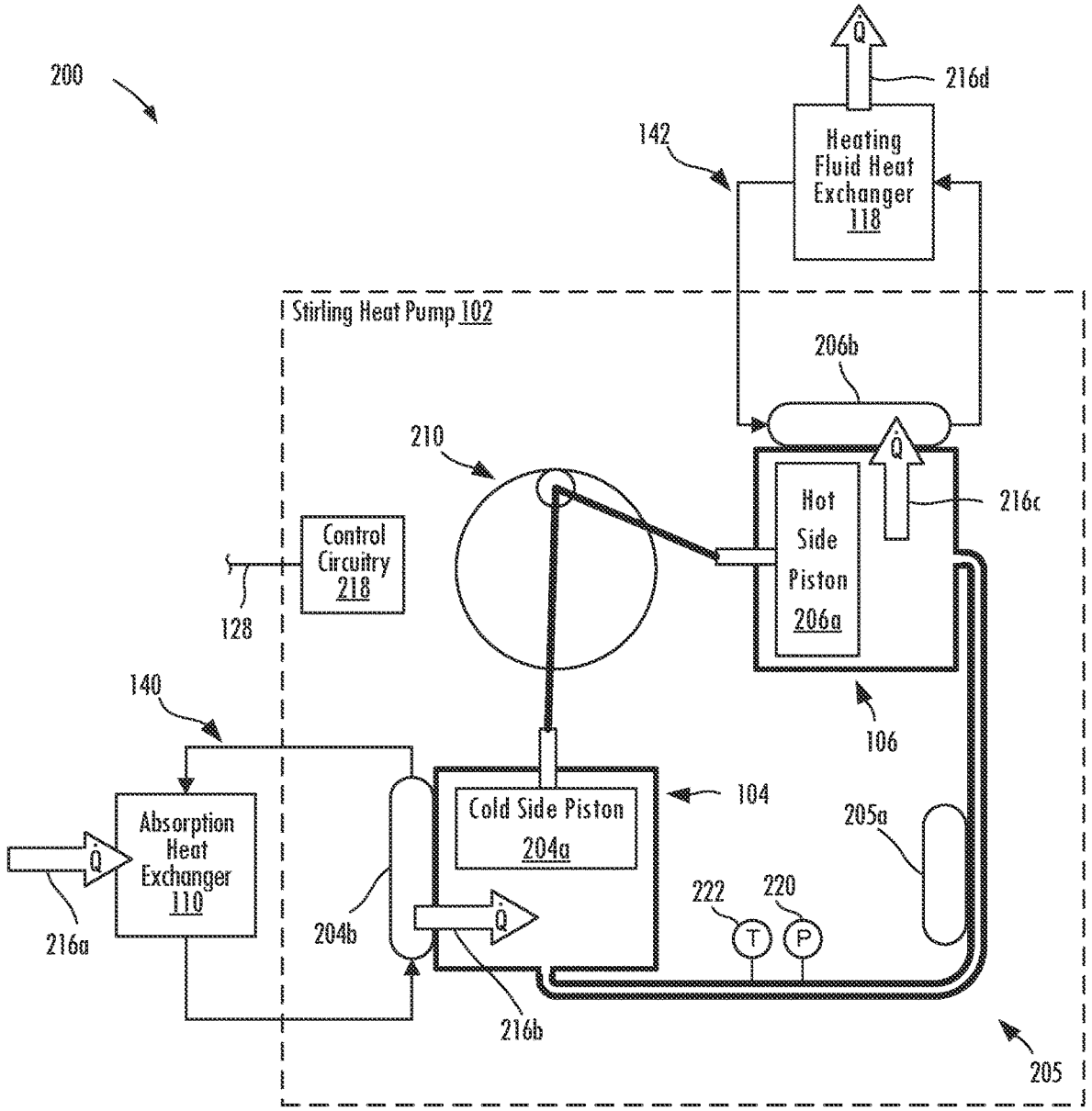
FIG. 2 illustrates a schematic diagram of a Stirling heat pump system, according to some example implementations of the present disclosure.

Turning now to FIG. 2, an example Stirling heat pump system 200 as depicted may generally comprise the Stirling heat pump 102 including, at least in part, the cold side chamber 104, the hot side chamber 106, a drive mechanism 210, a control circuitry 218, and a working fluid circuit 205. As shown, the cold side chamber 104 may further include a cold side piston 204*a* housed, at least in part, within the cold side chamber 104. Additionally, the cold side chamber 104 may be thermally coupled to a cold side heat sink 204*b* to absorb thermal energy from the heat absorption circuit 140 and transfer it to the working fluid within the cold side chamber 104. Moreover, as shown, the hot side chamber 106 may further include a hot side piston 206*a* housed, at least in part, within the hot side chamber 106. Additionally, the hot side chamber 106 may be thermally coupled to a hot side heat sink 206*b* to absorb thermal energy from the working fluid within the hot side chamber 106 and transfer it to the heating fluid circuit 142*a*.

As shown, the working fluid circuit 205 may further include, at least in part, a regenerator 205*a* for absorbing and rejecting heat during operation of the Stirling heat pump 102 as the working fluid flows between the cold side chamber 104 and the hot side chamber 106. The regenerator 205*a* may be an internal heat exchanger configured to temporarily store thermal energy between the cold side chamber 104 and hot side chamber 106. For example, as the working fluid passes through the working fluid circuit 205 first in one direction then in the reverse direction, a regenerator 205*a* may absorb, at least some, thermal energy from the working fluid moving in the first direction and then the regenerator 205*a* may reject, at least some, thermal energy back into the working fluid moving back in the reverse direction. In some examples, the regenerator 205*a* may include an involute foil regenerator that, at least in part, encircles the working fluid circuit 205. In such examples, an involute foil regenerator may comprise a plurality of layers of foil materials, e.g., different layers and lengths of metal and/or other materials to improve heat transfer between the regenerator and the working fluid. In some examples, the regenerator x205*a* may be located at any location along the working fluid circuit x205. In some examples, the regenerator x205*a* may, at least in part, be coupled to the working fluid circuit x205, the cold side chamber x104, and/or the hot side chamber x106. In some examples, the regenerator x205*a* may be a plurality of regenerators.

The drive mechanism 210, as shown, may include at least a motor coupled to a crankshaft that is further coupled, via linkages, to at least the hot side piston 206*a* and the cold side piston 204*a*. The drive mechanism 210 may rotate to provide motive force to at least the hot side piston 206*a* and/or the cold side piston 204*a* in order to actuate each of the hot side piston 206*a* and/or the cold side piston 204*a*. It should be understood that as the drive mechanism 210 rotates the cold side piston 204*a* and/or the hot side piston 206*a* may push and/or pull, at least in part, the working fluid from the cold side chamber 104 through at least the working fluid circuit 205 and into the hot side chamber 106. As the drive mechanism 210 continues to rotate the working fluid may be pushed from the hot side chamber 106 through at least the working fluid circuit 205 and into the cold side chamber 104.

In some examples, the system utilizes the Stirling heat pump to provide cooling capacity, in which case the above discussed system is largely reversed such that the use side fluid circuit, e.g., the circuit coupled to the climate control system is coupled to the cold side of the Stirling heat pump. In some such examples, one or more of the cold side heat sink 204*b*, hot side heat sink 206*b*, indoor heat exchanger, and/or outdoor heat exchanger fluidly and/or thermally coupled to the Stirling heat pump may be enlarged, at least in part, to improve heat transfer for low temperature gradients. It should be appreciated that in general to deliver cooling capacity the Stirling heat pump system may require more surface area for heat transfer than is required for delivering heating capacity.

Moreover, as shown, the Stirling heat pump 102 may be configured with at least a temperature sensor 222 and/or a pressure sensor 220 for monitoring one or more temperatures and/or pressures within the Stirling heat pump 102, e.g., at the hot side chamber 106, at the cold side chamber 104, along the working fluid circuit 205, or another location within the Stirling heat pump 102. The temperature sensor 222 may be communicatively coupled, at least in part, to the control circuitry 218 and may be further configured to transmit a temperature indication representative of a temperature to the control circuitry 218. Furthermore, the temperature sensor 222 may receive, from the control circuitry 218, a command indication representative of a command to transmit a temperature indication to, at least in part, the control circuitry 218. The pressure sensor 220 may be communicatively coupled, at least in part, to the control circuitry 218 and may be further configured to transmit a pressure indication representative of a pressure to the control circuitry 218. Furthermore, the pressure sensor 220 may receive, from the control circuitry 218, a command indication representative of a command to transmit a pressure indication to, at least in part, the control circuitry 218.

The control circuitry 218 may transmit, based at least in part on a temperature and/or pressure indication, a speed indication to the drive mechanism 210, or a component thereof, representative of a command to increase or decrease the speed of rotation of the drive mechanism 210. Upon receipt of the speed indication the drive mechanism 210 may increase or decrease its speed of rotation. In some examples, the control circuitry 218 may include in whole, or in part, the control circuitry 600 described below with respect to FIG. 6.

Now that the general componentry of the Stirling heat pump 102 has been walked through above, we will now walkthrough general examples for transferring thermal energy through the Stirling heat pump system 200 during the operation of the Stirling heat pump 102.

Assuming in our example that the Stirling heat pump 102 is turned off, or in an idle mode, the control circuitry 218 may first receive an activation indication representative of a command to turn on, or activate, the Stirling heat pump 102. The control circuitry 218 may further transmit a speed indication to the drive mechanism 210, or a controller thereof, commanding the drive mechanism 210 to begin rotating, e.g., at a predefined speed. As the drive mechanism 210 rotates the working fluid may be pushed and/or pulled, at least in part, back and forth between the hot side chamber 106 and the cold side chamber 104 via the working fluid circuit 205 as described herein.

Further, as the working fluid is pushed and/or pulled into the cold side chamber 104, e.g., by at least the hot side piston 206*a* and/or the cold side piston 204*a*, the working fluid may be expanded and this expansion of the working fluid may cause it to absorb thermal energy, e.g., through the walls of the cold side chamber 104 from the cold side heat sink 204*b* as represented by the heat transfer arrow 216*b*. As shown, the cold side heat sink 204*b* may be fluidly coupled to the heat absorption circuit 140 and may be thermally coupled, but may not be fluidly coupled, to the walls of the cold side chamber 104 to allow for thermal energy to transfer from the heat absorption fluid of the heat absorption circuit 140 to the working fluid of the Stirling heat pump 102. In some examples, the cold side chamber 104 and/or the cold side piston 204*a* may be sized to define a maximum volume for expansion of the working fluid during the expansion phase described above, e.g., based at least in part on the volume of the working fluid in the Stirling heat pump 102. In some examples, the relative position of each piston, e.g., to each other, during the angular rotation of the crankshaft of the drive mechanism 210 may further define the maximum volume for expansion of the working fluid during the expansion phase described above. In some examples, a variable frequency drive (e.g., connected, at least in part, to the drive mechanism 210) may be utilized to control the timing, length of time, and/or speed of the expansion phase and/or compression phase (described further below). In such examples, the variable frequency drive may allow for a generally smaller Stirling heat pump, e.g., because faster speeds may provide for faster heat transfer. For example, a smaller Stirling heat pump may transfer less thermal energy per an expansion and compression cycle. However, the smaller Stirling heat pump may be able to complete more cycles per unit of time than a larger Stirling heat pump, resulting in more net heat transfer per unit of time.

In some examples, the cold side heat sink 204*b* may include a heat exchanger coil wrapped, at least in part, around the exterior surface of the cold side chamber 104. In such examples, the cold side heat sink 204*b* may comprise, at least in part, the heat absorption circuit 140. In some examples, the cold side heat sink 204*b* may include a plate heat exchanger, a fin-type heat exchanger, a monolithic heat exchanger, a tubular heat exchanger, a flat tubular heat exchanger, a vertical tubular heat exchanger, and/or the like. For example, the cold side chamber 104 may, at least in part, be wrapped in a tube bundle of tubular heat exchangers which may be further enclosed, at least in part, within another larger fluid vessel, e.g., connected to another working fluid circuit to facilitate thermal transfer therewith. In some examples, the hot side heat sink 206*b* (described further below) may be the same, substantially similar to, or different from the cold side chamber 104. In some examples, the cold side chamber 104 may be larger than the hot side heat sink 206*b*.

In the depicted examples, the thermal energy received by the Stirling heat pump 102 may be provided, at least in part, from an outdoor ambient environment. For example, the heat absorption circuit 140, as shown, may receive thermal energy from an outdoor ambient environment via at least the absorption heat exchanger 110 as represented by the heat transfer arrow 216*a* in order to transfer this thermal energy to the Stirling heat pump 102. For context, the thermal energy from the outdoor ambient environment may be absorbed into the heat absorption fluid in the heat absorption circuit 140, at least in part, because the temperature of the cold side chamber 104 may be lower than the outdoor ambient environment. For example, even at low outdoor ambient temperatures, e.g., of −10° F., the cold side chamber 104 may be configured to reach even lower temperatures, e.g., of −40° F., creating a larger temperature differential at low temperatures, e.g., than between the outdoor ambient environment and the refrigerant fluid circuit 134. In some examples, the heat absorption circuit 140 may receive thermal energy, e.g., represented by the heat transfer arrow 216*a*, from other sources, e.g., geothermal, waste heat from a machine or process, and/or the like.

Still referring to FIG. 2, as the working fluid is pulled and/or pushed into the hot side chamber 106, e.g., by at least the hot side piston 206*a* and/or the cold side piston 204*a*, the working fluid may be compressed and this compression of the working fluid may cause it to reject thermal energy, e.g., through the walls of the hot side chamber 106 to the hot side heat sink 206*b* as represented by the heat transfer arrow 216*c*. As shown, the hot side heat sink 206*b* may be fluidly coupled to the heating fluid circuit 142*a* and may be thermally coupled, but may not be fluidly coupled, to the walls of the hot side chamber 106 to allow for thermal energy to transfer from the working fluid of the Stirling heat pump 102 to the heating fluid of the heating fluid circuit 142*a*. In some examples, the hot side chamber 106 and/or the hot side piston 206*a* may be sized to define a minimum volume for compression of the working fluid during the compression phase described above, e.g., based at least in part on the volume of the working fluid in the Stirling heat pump 102. In some examples, the relative position of each piston during the angular rotation of the crankshaft of the drive mechanism 210 may further define the minimum volume for compression of the working fluid during the expansion phase described above. In some examples, the hot side heat sink 206*b* may include a heat exchanger coil wrapped, at least in part, around the exterior surface of the hot side chamber 106. In such examples, the hot side heat sink 206*b* may comprise, at least in part, the heating fluid circuit 142*a*. In some examples, the hot side heat sink 206*b* may include a plate heat exchanger, a fin-type heat exchanger, a monolithic heat exchanger, a tubular heat exchanger, a flat tubular heat exchanger, a vertical tubular heat exchanger, and/or the like. In some examples, the hot side heat sink 206*b* may be smaller than the cold side chamber 104.

As shown, the heating fluid circuit 142*a* may reject thermal energy from the heating fluid heat exchanger 118 as represented by the heat transfer arrow 216*d*. In such examples, the rejected thermal energy from the heating fluid heat exchanger 118 may be used to heat the conditioned air circulated through an air handling unit as described in further detail below. In some examples, the heating fluid circuit 142*a* may reject thermal energy via at least the hot water heating coil 116*a* to the water of the hot water heater 116, as described in further detail below. In some examples, the hot water heating coil 116*a* may be a primary heat source for heating the water of the hot water heater 116. In these examples, the hot water heating coil 116*a* may be the only source for actively heating the water, e.g., the hot water heater does not include any other heating sources such as a burners, electric heating element, etc. In other examples, the hot water heating coil 116*a* may be a secondary heat source for assisting a primary heat source, e.g., a burner, an electrical heating element, or the like, with supplemental heating of the water of the hot water heater 116. In such examples, the operation of the primary heat source (e.g., a burner, an electrical heating element, or the like) may be suppressed (e.g., removed from the hot water heater, at least temporarily deactivated, at least temporarily reduced in operation, or the like) while the hot water heating coil 116*a* at least partially replaces the primary heat source for heating the water of the hot water heater 116. In some examples, the hot water heating coil 116*a* may be any heat exchanger, e.g., tubular, tube fin, coil, or the like, for exchanging thermal energy between the water of the hot water heater 116 and the heating fluid.

Furthermore, in some examples, the Stirling heat pump 102 may continue to operate for a period of time, until a heating demand is met, and/or until another threshold condition is met. In such examples, the Stirling heat pump system 200 may continue to absorb thermal energy from the outdoor ambient environment and reject thermal energy to the heating fluid heat exchanger 118 or the like as described above.

The example Stirling heat pump 102 as depicted in FIG. 2, and described above, may be an alpha Stirling heat pump generally including two pistons in two separate chambers, however, other example Stirling heat pump configurations may be utilized with the present disclosure. In some examples, the Stirling heat pump 102 may include a beta Stirling heat pump generally comprising a single chamber including a hot end of the chamber, a cold end of the chamber, a compression piston for compressing/expanding the working fluid, and a displacer piston for displacing the working fluid between the hot end and the cold end. Still further Stirling heat pump configurations may be utilized with the present disclosure, e.g., a gamma Stirling heat pump or the like.

Now that some general examples for transferring thermal energy through the Stirling heat pump system 200 during the operation of the Stirling heat pump 102 have been described above, we will continue to describe the overview of example heating systems, and components thereof, below with additional reference to FIG. 1.

Returning to FIG. 1, as shown, the heat absorption circuit 140 may be thermally coupled to the cold side chamber 104 of the Stirling heat pump 102, as described above, and may include a circulation pump 108*b* and an absorption heat exchanger 110 of the outdoor unit 112*a*. In some examples, the circulation pump 108*b*, e.g., an absorption fluid circulation pump, may be coupled to the heat absorption circuit 140, as shown, and may be configured to circulate a heat absorption fluid through the heat absorption circuit 140. In some examples this is in response to a command indication received from the control circuitry 136 or the like. As the heat absorption fluid circulates through the heat absorption circuit 140 it may flow, at least in part, through the absorption heat exchanger 110, e.g., an absorption heat exchanger coil, coupled to the heat absorption circuit 140, as shown. Further, the heat absorption circuit 140 may be configured to exchange thermal energy between the heat absorption fluid and an outdoor ambient environment. For example, absorption heat exchanger 110 may be a tube fin heat exchanger coil that absorbs thermal energy from the air of the outdoor ambient environment and transfers at least some of the absorbed thermal energy into the heat absorption fluid of the heat absorption circuit 140. In some examples, the outdoor unit 112*a* or the like may include an outdoor fan 144*a* for blowing air of the outdoor ambient environment across an exterior surface of the absorption heat exchanger 110 to increase the thermal energy exchange. In some examples, this is in response to a command indication received from the control circuitry 136 or the like. In some examples, the heat absorption fluid flowing toward the cold side chamber 104 may be generally warmer than the heat absorption fluid flowing away from the cold side chamber 104. In some examples, the outdoor fan 144*a* may be the same or similar to the outdoor fan 144*b* and/or the outdoor fan 518 as described below with respect to FIG. 5.

The heating fluid circuit 142*a*, as shown, may be thermally coupled to the hot side chamber 106 of the Stirling heat pump 102 and may include a circulation pump 108*a*, control valves 114*a*-114*b*, hot water heating coil 116*a* of the hot water heater 116, and a heating fluid heat exchanger 118 of the indoor unit 124. Further, the heating fluid circuit 142*a* may be configured to selectively circulate a heating fluid through, at least in part, one or more circulation pumps 108*a*, the control valves 114*a*-114*b*, the hot water heating coil 116*a*, or the heating fluid heat exchanger 118. The circulation pump 108*a*, coupled to the heating fluid circuit 142*a*, may provide the motive force to circulate the heating fluid through the heating fluid circuit 142*a*, potentially in response to a circulation indication provided by the control circuitry 136.

Additionally, the control valve 114*a* may receive the heating fluid circulated by the circulation pump 108*a*, as shown, and may selectively adjust the flow of the heating fluid to direct the flow, at least in part, to the hot water heating coil 116*a* and/or the heating fluid heat exchanger 118, potentially in response to a command indication provided by the control circuitry 136. After the heating fluid has been circulated through the hot water heating coil 116*a* and/or the heating fluid heat exchanger 118 it may be received by the control valve 114*b* as shown. The control valve 114*b* may direct the flow of the heating fluid toward the hot side chamber 106 as shown so that it may, at least in part, be reheated and recirculated through the heating fluid circuit 142*a*. In the depicted example, the hot water coil 116*a* and the heating. fluid heat exchanger 118 are shown in parallel, however, it is understood that the heating fluid circuit 142 may arrange these components in series. Further, in some examples, the heating fluid circuit may also include bypass circuits to selectively bypass these components, potentially using a control valve or other device. Other configurations may also be used.

The heating fluid heat exchanger 118, e.g., an air conditioning heating coil as shown, may be configured to receive a heating fluid from the control valve 114*a* and to further heat the conditioned air circulated through the indoor unit 124, e.g., an air handling unit as shown. In some examples, the heating fluid heat exchanger 118 may include a cased coil, an A-coil, an N-coil, a slab coil, a tube fin heat exchanger, and/or the like. In some examples, the heating fluid heat exchanger 118 may be configured with one or more temperature and/or pressure sensors configured to monitor the temperature and/or pressure of the heating fluid heat exchanger 118.

The hot water heating coil 116*a*, e.g., a hot water heater heat exchanger, as shown, may be configured to receive a heating fluid from the control valve 114*a* and to further heat the water within the hot water heater 116, e.g., within a water tank as shown. In some examples, the hot water heating coil 116*a* may include a spiral coil that wraps around the bottom, sides, and/or top of the interior and/or exterior of the hot water heater 116 to exchange thermal energy between the heating fluid within the hot water heating coil 116*a* and the water within the hot water heater 116. In some examples, the hot water heating coil 116*a* may include a tubular heat exchanger that at least partially defines the walls of the hot water heater 116.

The hot water heater 116, as shown, may include, at least in part, a hot water heating coil 116*a* (as described above). In some examples, the hot water heater 116 may include a heat source 117, e.g., in addition to the hot water heating coil 116*a*. The heat source 117 may include one or more of an electrical heating element, a gas burner, or the like to heat water within the hot water heater 116. In some examples, the heat source 117 may be housed within a housing of the hot water heater 116, e.g., electrical heating element in contact with the water of the hot water heater 116. In other examples, the heat source 117 may be, at least in part, external relative to a housing of the hot water heater 116, e.g., a gas burner housed below the hot water heater 116. In some examples, the heat source 117 may be a supplemental and/or secondary heat source for heating hot water, e.g., when the Stirling heat pump is providing conditioned air heating capacity for a prolonged period of time, during maintenance of the Stirling heat pump, or other such examples when the Stirling heat pump cannot supply sufficient hot water.

In some examples, the hot water heater 116 may include one or more of a water tank or a tankless water heater. In some examples, a tankless water heater may be configured to dynamically exchange thermal energy with the hot water heating coil 116*a* in response to a current demand for hot water, e.g., from a homeowner opening a hot water faucet or the like. In some examples, a water tank may be configured to exchange thermal energy with the hot water heating coil 116*a* periodically in order to maintain a predefined water temperature within the water tank, e.g., whether or not there is a current demand for hot water. In some examples, the hot water heating coil 116*a* and/or the hot water heater 116 may be configured with one or more temperature and/or pressure sensors configured to monitor the temperature and/or pressure within the hot water heater 116 in order to regulate at least the temperature of the water within the hot water heater 116, e.g., based on indications provided by the control circuitry 136.

The refrigerant fluid circuit 134, as shown, may include an indoor heat exchanger 122 of the indoor unit 124, a modulating valve 132 of the indoor unit 124, a compressor 138 of the outdoor unit 112*b*, and an outdoor heat exchanger 130 of the outdoor unit 112*b*. In some examples, the refrigerant fluid circuit 134 may include in whole, or in part, the refrigerant fluid circuit 534 of the climate control system 500 described below with respect to FIG. 5.

The indoor unit 124, e.g., an air handling unit as shown, may include the heating fluid heat exchanger 118 fluidly coupled to the heating fluid circuit 142*a*, an indoor fan 120, and the indoor heat exchanger 122 fluidly coupled to the refrigerant fluid circuit 134. In some examples, the indoor unit 124 may include in whole, or in part, the indoor air handling unit 300 described below with respect to FIG. 3. In some examples, the indoor unit 124 may include in whole, or in part, the indoor unit 502 of the climate control system 500 described below with respect to FIG. 5.

Now that some general examples for the indoor unit 124 have been described above, the below will continue to describe indoor air handling units in further detail below with additional reference to FIG. 3.

Figure 3:
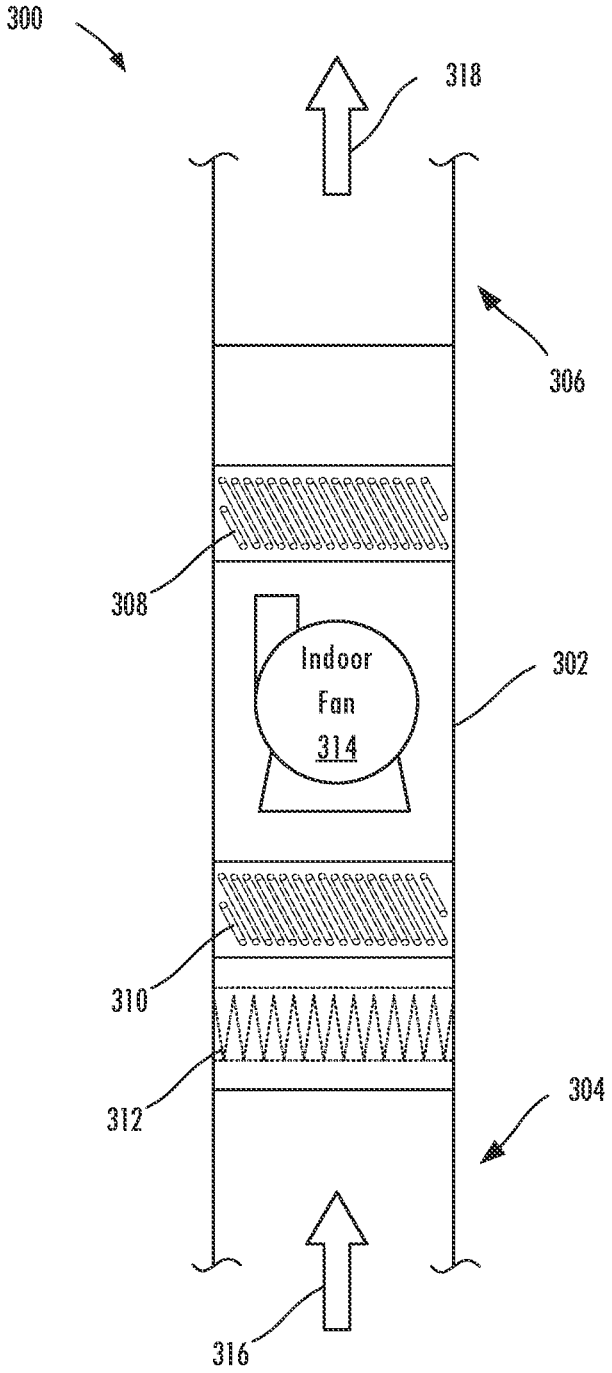
FIG. 3 illustrates a schematic diagram of an indoor air handling unit, according to some example implementations of the present disclosure.

Turning now to FIG. 3, an example indoor air handling unit 300, as depicted, may generally comprise a housing 302, a heating fluid heat exchanger 308, an indoor refrigerant heat exchanger 310, and an indoor fan 314. The housing 302, in some examples, may define an interior space for conveying air through and/or housing one or more components of the indoor air handling unit 300, e.g., an air conditioning heating coil, an indoor heat exchanger, or the like. Further, the housing 302 may be a sheet metal cabinet, or the like, that is fluidly coupled to a duct system, e.g., via at least the return duct 304 and/or the supply duct 306. The indoor air handling unit 300 may be coupled at a first end, as shown, to a return duct 304. The return duct 304 may provide air for conditioning to the indoor air handling unit 300 which may then condition, e.g., heat/cool, the air and circulate the conditioned air through a conditioned space, e.g., via a duct system. Further, the indoor air handling unit 300 may be coupled at a second end, as shown, to a supply duct 306. The supply duct 306 may receive the conditioned air from the indoor air handling unit 300 and may further convey the conditioned air to, at least in part, through a duct system to a conditioned space. As depicted, air entering the indoor air handling unit 300 via the return duct 304 may be represented by arrow 316 and air exiting the indoor air handling unit 300 via the supply duct 306 may be represented by arrow 318. In some examples, the indoor fan 314 may provide the motive force to at least pull the incoming air from the return duct 304 and push the conditioned air out through the supply duct 306.

In some examples, the heating fluid heat exchanger 308, e.g., an air conditioning heating coil, may be the same or similar to the heating fluid heat exchanger 118 as described above. For example, the heating fluid heat exchanger 308 may be configured to receive a heating fluid such as a water glycol mixture, or the like, that has been heated by the Stirling heat pump 102. The heating fluid heat exchanger 308 may further radiate some of the heat from, e.g., the water glycol mixture to the air within the indoor air handling unit 300. In some examples, the heating fluid heat exchanger 308 may include a microchannel heat exchanger. The microchannels of the microchannel heat exchanger may have a hydraulic and/or inner diameter of approximately 1 mm or less. In some examples, the heating fluid heat exchanger 308 may include a fluid flow path including, at least in part, a non-flowing portion. The non-flowing portion may, at least in part, include the microchannel heat exchanger. It should be understood that a non-flow process in thermodynamics is a process in which at least heat transfer may occur without there being any mass transfer, e.g., the working fluid is not being pumped.

The indoor refrigerant heat exchanger 310, in some examples, may be the same or similar to the indoor heat exchanger 122 as described above. As shown, the indoor refrigerant heat exchanger 310 may be located within the housing 302 of the indoor air handling unit 300 in order to exchange, e.g., absorb and/or reject, thermal energy between a refrigerant fluid and the conditioned air of the indoor air handling unit 300.

For example, the indoor refrigerant heat exchanger 310 may be configured to receive a refrigerant fluid such as R-134a, or the like, and may operate, e.g., with the modulating valve 132 (shown in FIG. 1), as an evaporator coil for evaporating the refrigerant fluid from a liquid phase to a gaseous phase, e.g., refrigerant fluid absorbs thermal energy cooling the air within the indoor air handling unit 300. In such examples, the heating fluid heat exchanger 308 may provide heating capacity for a climate control system while the indoor refrigerant heat exchanger 310 may provide cooling capacity for the climate control system.

In some other examples, the indoor refrigerant heat exchanger 310 may be configured as a primary indoor coil to provide both heating and cooling capacity, e.g., by exchanging thermal energy between a refrigerant fluid and a conditioned air. For example, the indoor refrigerant heat exchanger 310 may be configured to receive a refrigerant fluid such as R-134a, or the like, and may operate, at least in part, as a condenser coil for condensing the refrigerant fluid from a gaseous phase to a liquid phase, e.g., refrigerant fluid releases thermal energy heating the air within the indoor air handling unit 300. In such examples, the heating fluid heat exchanger 308 may provide supplemental heating capacity for a climate control system in addition to heating capacity provided by the indoor refrigerant heat exchanger 310. In some examples, the indoor refrigerant heat exchanger 310 may provide heating capacity for a climate control system when the outdoor ambient temperature is above a predefined threshold value. In such examples, the heating fluid heat exchanger 308 may be configured as a secondary air conditioning heating coil to provide supplemental heating capacity for a climate control system when the outdoor ambient temperature is below a predefined threshold value, e.g., in addition to the indoor refrigerant heat exchanger 310. In such examples, the indoor fan 314 may circulate the conditioned air over both the primary indoor coil and the secondary air conditioning heating coil to condition the air, e.g., whether one or both coils are providing the conditioning capacity.

In other examples, the heating fluid heat exchanger 308 may provide the only source of heating capacity for the climate control system when the outdoor ambient temperature is below a predefined threshold value, e.g., when the heat pump of the refrigerant fluid circuit 134 ceases operation or when the heat pump of the refrigerant fluid circuit 134 can no longer absorb thermal energy from the outdoor ambient environment to exchange with the conditioned air. It should be appreciated that refrigerant vapor compressor based heat pumps may start to lose heating capacity at approximately 20° F. to 25° F. and may continue to lose more heating capacity as temperatures reduce below approximately 20° F.

The indoor air handling unit 300, as shown, may further comprise an electric heating element 312 in addition to the heating fluid heat exchanger 308 and the indoor refrigerant heat exchanger 310. For example, the indoor air handling unit 300 may be an older air handling unit that has been retrofitted for use with the heating system 100 as described herein. In such examples, the electric heating element 312 may provide supplemental heating capacity for a climate control system in addition to any heating capacity provided by the heating fluid heat exchanger 308. In other examples, the electric heating element 312 may be deactivated, e.g., electrically disconnected, or physically removed from the indoor air handling unit 300, and the heating fluid heat exchanger 308 alone may provide supplemental heating capacity and/or the only heating capacity as described above. It should be understood that deactivating or physically removing the electric heating element 312 may be desirable because such electric heating elements may be less efficient and/or more costly to operate when compared with the heating fluid heat exchanger 308 as described above. In some examples, the indoor air handling unit 300 may be manufactured without the electric heating element 312, e.g., the indoor air handling unit 300 may be manufactured for use with the heating system 100 as described herein. In some examples, the electric heating element 312 may include a heat strip, an electrical resistor, and/or other electrical device for converting electrical energy into thermal energy.

Now that some examples of indoor air handling units have been described in detail above with additional reference to FIG. 3, the below will continue to describe the overview of example heating systems, and components thereof, below with additional reference to FIG. 1.

Returning to FIG. 1, the outdoor unit 112*b*, as shown, may include the outdoor heat exchanger 130 and the compressor 138, both fluidly coupled to the indoor heat exchanger 122, e.g., via the refrigerant fluid circuit 134. In some examples, the outdoor unit 112*b* may include the absorption heat exchanger 110 fluidly coupled to the heat absorption circuit 140 and/or a modulating valve, e.g., modulating valve 132 or the like. In some examples, the outdoor unit 112*b* may further include an outdoor fan 144*b* as shown. In some examples, the outdoor fan 144*b* may be the same or similar to the outdoor fan 144*a* described above and/or the outdoor fan 518 as described below with respect to FIG. 5.

The outdoor unit 112*a* and the outdoor unit 112*b*, in some examples may comprise the same outdoor unit of a climate control system. For example, the absorption heat exchanger 110 may be co-located within a housing of an outdoor unit of a climate control system with the outdoor heat exchanger 130, the compressor 138 or the like as described below. Further, the outdoor heat exchanger 130 may be configured to exchange thermal energy between a refrigerant fluid and the outdoor ambient environment, e.g., as a condenser and/or evaporator coil. Moreover, the outdoor unit 112*a*, the outdoor unit 112*b*, and/or the like may further include an outdoor fan (as shown in FIG. 5) that may circulate outdoor ambient air over the outdoor heat exchanger 130 and/or the absorption heat exchanger 110, e.g., to increase a rate of exchange of thermal energy between a respective heat exchanger fluid and the outdoor ambient environment. In some examples, the outdoor unit 112*a* and/or the outdoor unit 112*b* may include in whole, or in part, the outdoor unit 504 of the climate control system 500 described below with respect to FIG. 5.

The control circuitry 136, as shown, may be communicatively coupled, at least in part, to the circulation pumps 108*a*-108*b*, the outdoor units 112*a*-112*b*, the control valves 114*a*-114*b*, the Stirling heat pump 102, the hot water heater 116, the indoor unit 124, and/or any components thereof. Further, as shown, the control circuitry 136 may be communicatively coupled to the one or more components of the heating system 100, or the like, via at least the communication bus 128 which may include in whole, or in part, the communication bus 528 of the climate control system 500 described below with respect to FIG. 5. In some examples, the control circuitry 136 may include in whole, or in part, any control circuitry of the climate control system 500 described below with respect to FIG. 5. In some examples, the control circuitry 136 may include in whole, or in part, the control circuitry 600 described below with respect to FIG. 6.

Now that the general componentry for example heating systems for providing hot water and/or heating capacity have been described above, the below will walk through some example processes for providing hot water and/or heating capacity with the example heating systems in more detail below with reference to FIGS. 4A-4G.

FIGS. 4A-4G show an example process 400 for heating both conditioned air and water using a heating fluid. The process 400 may be carried out, at least in part, by one or more apparatuses, components, circuits, and/or the like according to some examples of the present disclosure. In some examples, the process 400 may be performed by at least the control circuitry, e.g., 136, 600, and/or the like. In some examples, the process 400 may be performed by two or more control circuits that are, at least in part, communicatively coupled together, e.g., a system controller, outdoor controller, indoor controller, and/or the like. In some examples, the process 400 may utilize one or more other components of the heating systems and/or climate control systems described herein, e.g., the Stirling heat pump 102, the circulation pumps 108*a*-108*b*, the control valves 114*a*-114*b* and/or the like.

Figure 4A:
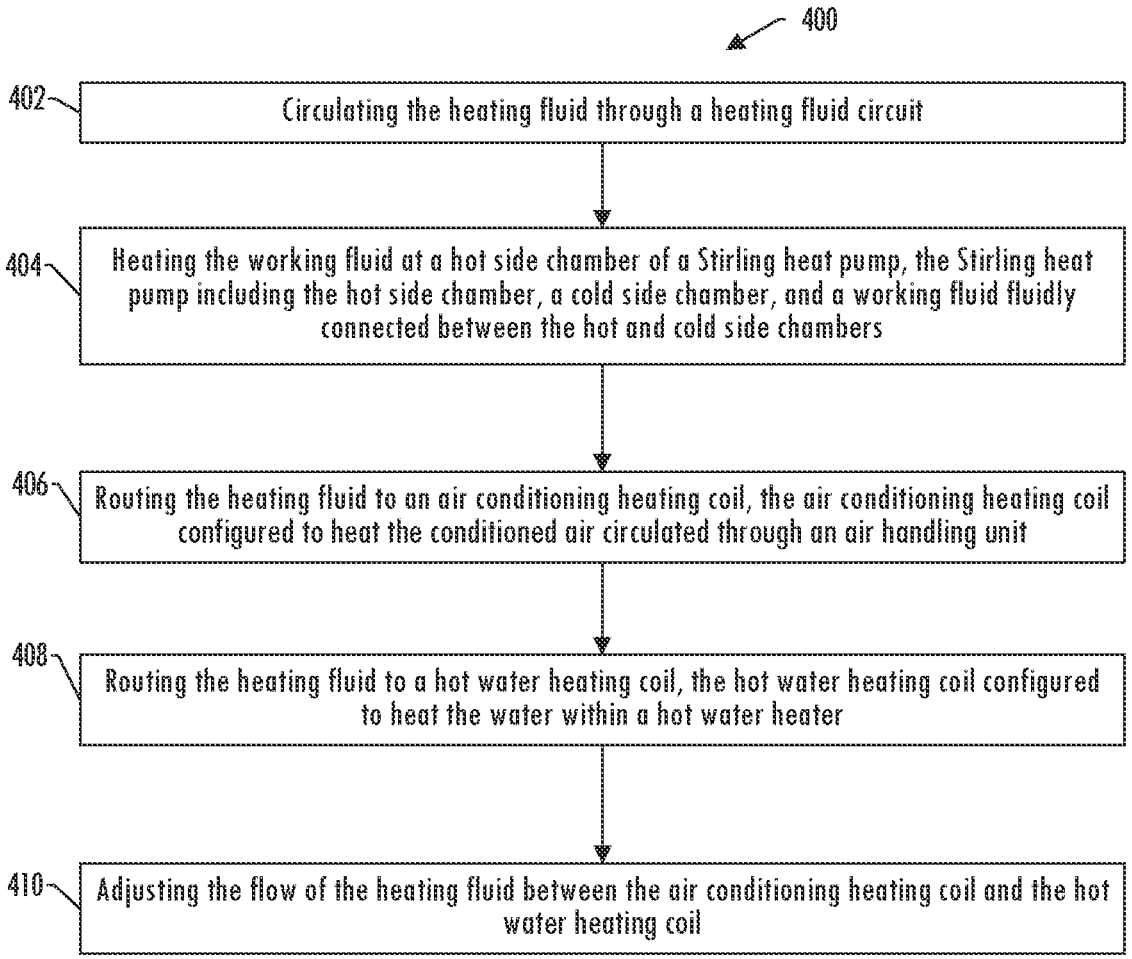

Referring first to the examples provided in FIG. 4A, the process 400 may include circulating a heating fluid through a heating fluid circuit, as shown at step 402. As shown at step 404, the process 400 may include heating a working fluid at a hot side chamber of a Stirling heat pump. The Stirling heat pump may include the hot side chamber, a cold side chamber, and a working fluid fluidly connected between the hot and cold side chambers. The process 400 may further include routing the heating fluid to an air conditioning heating coil, the air conditioning heating coil configured to heat the conditioned air circulated through an air handling unit, as shown at step 406. The process 400 may include routing the heating fluid to a hot water heating coil, the hot water heating coil configured to heat the water within a hot water heater, as shown at step 408. Further, as shown at step 410, the process 400 may include adjusting the flow of the heating fluid between the air conditioning heating coil and the hot water heating coil.

To further walk through the process of controlling, at least in part, a heating system, each of steps 402-410 described above will now be discussed in more detail with further reference to FIGS. 4B-4G below.

As shown at step 402, the process 400 may include circulating the heating fluid through a heating fluid circuit. This may include activating or turning on one or more components of a heating system and/or a climate control system as described herein, at step 402. The request for heating, in some examples, may be based on a temperature setpoint, potentially set by a user, e.g., a homeowner or the like, set by the manufacture, or another process. In some examples, the control circuitry may initiate a request for heating if a given condition is below the temperature setpoint. This process may be done through any process, including any convention process for initiating heating for a water heater and/or a climate control system. To walk through an example, a user may select an indoor space operate in heating, potentially at a certain setpoint temperature. A thermostat may monitor the temperature in the indoor space, and if the temperature drops below a set value then a request for heating may be initiated. In some examples, this request may be elevated to a request for supplemental heating. For example, if a given standard heating process for a heat pump is not able to satisfy the load for a given space, then a request for supplemental heating may be initiated. In another example, using a water heater, the water heater may be set to a desired temperature, potentially based on a code requirement, e.g., 120° F. up to 140° F. Still other temperatures may be used or set by a homeowner. The temperature of the water within the tank may be controlled to be within a given range of that desired temperature, e.g., +/−2° F. If the temperature drops below that level, potentially due to a flow of hot water out of the system, heat leakage, etc., then the water heater may request additional heating to raise the temperature back to the desired temperature.

In such examples, the step 402 may include receiving and/or transmitting a request indication representative of the request for heating to the heating system or a component thereof to, at least in part, circulate the heating fluid through a heating fluid circuit. In some examples, the step 402 may include transmitting an activation indication representative of a command to turn on, or activate, the Stirling heat pump, a circulation pump of the heating fluid circuit, a circulation pump of the heat absorption circuit, and/or the like, e.g., to the Stirling heat pump, a circulation pump, and/or a control circuit thereof.

In some examples, the step 402 may further include controlling a speed of one or more components of a heating system and/or a climate control system. In some examples, the step 402 may further include transmitting a speed indication representative of a speed of operation, e.g., for the Stirling heat pump, a compressor, and/or a circulation pump. In such examples, the step 402 may further include receiving a speed indication representative of a speed of operation, e.g., from a motor sensor of the Stirling heat pump, and/or the like. In some examples, the step 402 may further include circulating the heat absorption fluid through a heat absorption circuit. In some examples, the step 402 may include opening and/or adjusting one or more control valves to allow the heating fluid to circulate through at least a portion of the heating fluid circuit, e.g., through a hot water heating coil and/or an air conditioning heating coil as described above. For example, the control circuitry may transmit a command indication representative of a command to adjust the position of a control valve of the heating system, e.g., to the control valve and/or a control circuit thereof.

In some examples, the step 402 may also include circulating a refrigerant fluid through a refrigerant fluid circuit of the climate control system, e.g., before or at substantially the same time as circulating the heating fluid through a heating fluid circuit. In such examples, the step 402 may further include transmitting a request indication representative of a request for heating to the climate control system or a component thereof to, at least in part, circulate the refrigeration fluid through a refrigerant fluid circuit. For example, the control circuitry may transmit a command indication representative of a command to turn on, or activate, a compressor of the climate control system, and/or the like, e.g., to the compressor and/or a control circuit thereof. Moreover, the control circuitry may transmit a command indication representative of a command to adjust the position of a switch over valve and/or a modulating valve of the climate control system, e.g., to the switch over valve, a modulating valve, and/or a control circuit thereof. In some examples, step 402 may further include operating the climate control system in a heating mode and receiving a request indication representative of a request for a heating capacity, e.g., by a system controller of the climate control system. In some examples, step 402 may further include receiving a request signal representing a request to increase a delivered capacity of the climate control system, e.g., an increased heating demand provided by a user via a thermostat and/or one or more temperature systems monitoring a space conditioned by the climate control system. In some examples, still further processes may be performed and/or indications may be transmitted and/or received by the control circuitry and/or other components of the heating systems described herein at step 402.

Turning next to step 404, the process 400 may include heating the working fluid, e.g., at a hot side chamber of a Stirling heat pump, the Stirling heat pump including the hot side chamber, a cold side chamber, and a working fluid fluidly connected between the hot and cold side chambers. In some examples, the step 404 may further include monitoring the temperature and/or pressure of the working fluid of the Stirling heat pump, e.g., via one or more temperature and/or pressure sensors of the Stirling heat pump as described herein. For example, the Stirling heat pump may include at least a temperature and/or a pressure sensor proximate the hot side chamber and/or the cold side chamber that monitor the temperature and/or the pressure of the working fluid, at least in part, while the Stirling heat pump is operating as described herein. In some examples, step 404 may further include receiving a temperature indication representative of a temperature, e.g., of the hot side chamber, at the control circuitry from the temperature sensor. For example, the temperature indication may represent a temperature at the hot side chamber to indicate to the control circuitry that the working fluid has reached and/or is maintaining a predefined temperature to provide the requested heated conditioned air and/or hot water. In some examples, the step 404 may also include transmitting a command indication representative of a command to transmit a temperature indication, e.g., from the control circuitry to a temperature sensor, in order to further cause receiving of the temperature indication, e.g., at the control circuitry from the temperature sensor. In some examples, the step 404 may also include automatically transmitting a temperature indication on a periodic basis.

In some examples, the step 404 may further include receiving a temperature indication representative of a temperature, e.g., of the cold side chamber, at the control circuitry from the temperature sensor. In some examples, the step 404 may further include receiving a temperature indication representative of a temperature, e.g., of the outdoor ambient environment, at the control circuitry from an outdoor temperature sensor of an outdoor unit. In such examples, step 404 may further include comparing the temperature at the cold side chamber with an outdoor ambient temperature to estimate a time for the working fluid to reach a predefined temperature to provide the requested heated conditioned air and/or hot water. In such examples, the control circuitry may base the estimation on a temperature differential, e.g., between the cold side chamber and the outdoor ambient temperature, and a predefined heating capacity for the Stirling heat pump. In some examples, still further processes may be performed and/or indications may be transmitted and/or received by the control circuitry and/or other components of the heating systems described herein at step 404.

Turning next to step 406, the process 400 may include routing the heating fluid to an air conditioning heating coil. The air conditioning heating coil may be configured to heat the conditioned air circulated through an air handling unit. In some examples, the step 408 may further include heating the conditioned air circulated through an air handling unit, e.g., by exchanging thermal energy between the air and the heating fluid. In some examples, the step 406 may further include transmitting an adjustment indication representative of a command to adjust the position of a control valve, e.g., to increase and/or decrease a flow rate and/or a flow direction of fluid through the control valve. For example, the control circuitry may adjust a control valve to direct the heating fluid, at least in part, from a hot side chamber of the Stirling heat pump through an air conditioning heating coil of an indoor unit as described herein. In some examples, the control circuitry may adjust a control valve to direct the heating fluid, at least in part, from a hot water heating coil of a hot water heater through an air conditioning heating coil of an indoor unit. In some examples, the step 406 may further include directing the heating fluid through an air conditioning heating coil of an indoor unit, e.g., in response to a request indication. In some examples, the step 406 may further include monitoring a temperature and/or pressure of the heating fluid and/or conditioned air of the indoor unit, e.g., via one or more temperature and/or pressure sensors of the indoor unit. In such examples, routing the heating fluid to an air conditioning heating coil may be based, at least in part, on the monitored temperature and/or pressure of the heating fluid and/or conditioned air of the indoor unit. In some examples, still further processes may be performed and/or indications may be transmitted and/or received by the control circuitry and/or other components of the heating systems described herein at step 406.

Turning next to step 408, the process 400 may include routing the heating fluid to a hot water heating coil. The hot water heating coil may be configured to heat the water within a hot water heater, e.g., a hot water tank. In some examples, the step 408 may further include heating the water within a water tank, e.g., by exchanging thermal energy between the water and the heating fluid. In some examples, the step 408 may further include transmitting an adjustment indication representative of a command to adjust the position of a control valve, e.g., to increase and/or decrease a flow rate and/or a flow direction of fluid through the control valve. For example, the control circuitry may adjust a control valve to direct the heating fluid, at least in part, from a hot side chamber of the Stirling heat pump through a hot water heating coil of a hot water heater. In some examples, the step 408 may further include directing the heating fluid through a hot water heating coil of a hot water heater, e.g., in response to a request for hot water. In some examples, the step 408 may further include monitoring a temperature and/or pressure of the heating fluid and/or water of the hot water heater, e.g., via one or more temperature and/or pressure sensors of the hot water heater. For example, the hot water tank may be set to a temperature of 120° F. to 140° F. The temperature of the hot water tank may be monitored by the control circuitry communicatively coupled to one or more thermocouples which are further thermally coupled to the hot water tank or the water therein. Further, when the temperature of the hot water tank drops to a minimum temperature threshold, e.g., 120° F.±2° F., the Stirling heat pump may turn on and start to reheat the hot water within the hot water tank. In some examples, the temperature of the hot water tank may drop because relatively cooler water is flowing into the tank and/or hotter water is flowing out of the tank, e.g., to a faucet or shower head. In some examples, routing the heating fluid to a hot water heating coil may be based, at least in part, on the monitored temperature and/or pressure of the heating fluid and/or water of the hot water heater.

Turning next to step 410, the process 400 may include adjusting the flow of the heating fluid between the air conditioning heating coil and the hot water heating coil. In some examples, the step 410 may further include transmitting an adjustment indication representative of a command to adjust the position of a control valve, e.g., to increase and/or decrease a flow rate and/or a flow direction of fluid through the control valve. In some examples, the step 410 may further include switching the flow of the heating fluid from the air conditioning heating coil to the hot water heating coil, or vice versa. In some examples, the step 410 may further include transmitting, to one or more control valves, a direction indication representative of a command to switch the position of a control valve, e.g., from a first flow direction position to a second flow direction position.

In some examples, adjusting the flow of the heating fluid between the air conditioning heating coil and the hot water heating coil may further include directing the heating fluid from the Stirling heat pump to either the air conditioning heating coil or the hot water heating coil and then back to the Stirling heat pump. In some examples, adjusting the flow of the heating fluid between the air conditioning heating coil and the hot water heating coil may further include directing the heating fluid from the Stirling heat pump to the air conditioning heating coil and the hot water heating coil and then back to the Stirling heat pump, e.g., in proportion to one or more requests for heating. In some examples, still further processes may be performed and/or indications may be transmitted and/or received by the control circuitry and/or other components of the heating systems described herein at step 410.

To further walk through the process of adjusting the flow of the heating fluid between the air conditioning heating coil and the hot water heating coil, step 410 described above will now be discussed in more detail with further reference to FIGS. 4B-4G below.

Figure 4B:
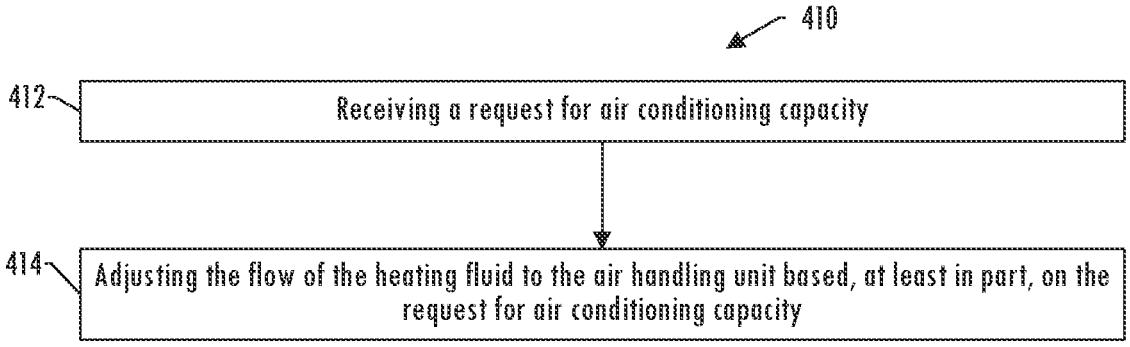

Turning now to FIG. 4B, in some examples, the step 410 may generally include step 412 and step 414 as shown.

Still with reference to FIG. 4B, the step 410 may further include receiving a request for air conditioning capacity, e.g., heating capacity from the climate control system, as shown at step 412. In some examples, the step 412 may further include receiving, at the control circuitry, a request indication representative of a request for air conditioning capacity. In some examples, the step 412 may further include transmitting, from the air handling unit and/or other component of a climate control system, a request indication representative of a request for air conditioning capacity.

Still with reference to FIG. 4B, the step 410 may further include adjusting the flow of the heating fluid to the air handling unit based, at least in part, on the request for air conditioning capacity, e.g., from the air handling unit or the like, as shown at step 414. In some examples, the step 414 may further include transmitting an adjustment indication representative of a command to adjust the position of a control valve, e.g., to increase and/or decrease a flow rate and/or a flow direction of fluid through the control valve. In some examples, the step 414 may further include one or more processes described for step 406.

Figure 4C:
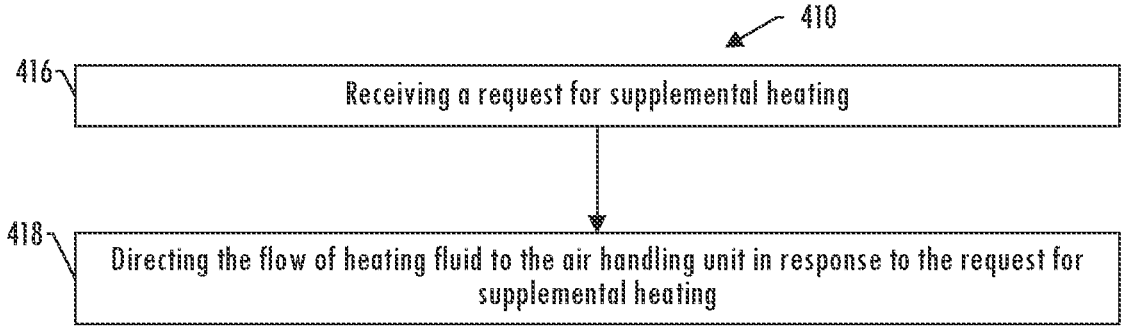

Turning now to FIG. 4C, in some examples, the step 410 may generally include step 416 and step 418 as shown.

Still with reference to FIG. 4C, the step 410 may further include receiving a request for supplemental heating, e.g., heating capacity in addition to the primary indoor heat exchanger of the climate control system, as shown at step 416. In some examples, the step 416 may further include receiving, at the control circuitry, a request indication representative of a request for supplemental heating. In some examples, the step 416 may further include transmitting, from the air handling unit and/or other component of a climate control system, a request indication representative of a request for supplemental heating.

Still with reference to FIG. 4C, the step 410 may further include directing the flow of heating fluid to the air handling unit in response to the request for supplemental heating, as shown at step 418. In some examples, the step 418 may further include switching the flow of the heating fluid from the hot water heater to the air conditioning heating coil. In some examples, the step 418 may further include transmitting, to one or more control valves, a direction indication representative of a command to switch the position of a control valve, e.g., from a first flow direction position to a second flow direction position. In some examples, the step 418 may further include one or more processes described for step 406.

Figure 4D:
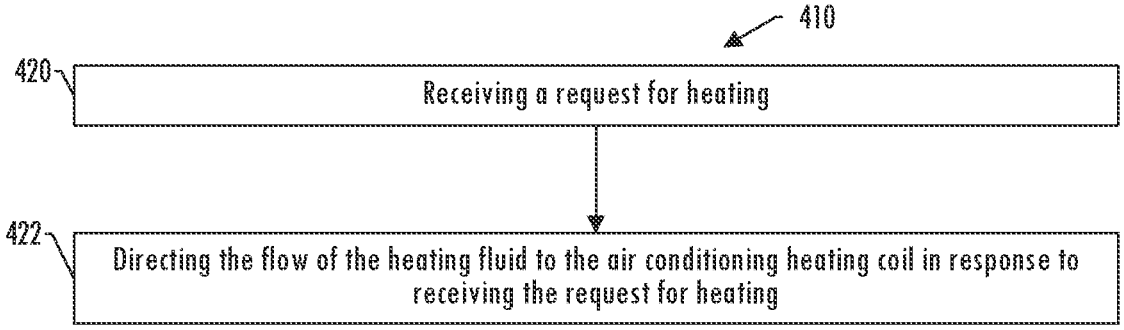

Turning now to FIG. 4D, in some examples, the step 410 may generally include step 420 and step 422 as shown.

Still with reference to FIG. 4D, the step 410 may further include receiving a request for heating, e.g., heating capacity with or without heating capacity from the primary indoor heat exchanger of the climate control system, as shown at step 420. In some examples, the step 420 may further include receiving, at the control circuitry, a request indication representative of a request for heating. In some examples, the step 420 may further include transmitting, from the air handling unit and/or other component of a climate control system, a request indication representative of a request for heating.

Still with reference to FIG. 4D, the step 410 may further include directing the flow of the heating fluid to the air conditioning heating coil in response to receiving the request for heating, as shown at step 422. In some examples, the step 422 may further include switching the flow of the heating fluid from the hot water heater to the air conditioning heating coil. In some examples, the step 422 may further include transmitting, to one or more control valves, a direction indication representative of a command to switch the position of a control valve, e.g., from a first flow direction position to a second flow direction position. In some examples, the step 422 may further include one or more processes described for step 406.

Figure 4E:
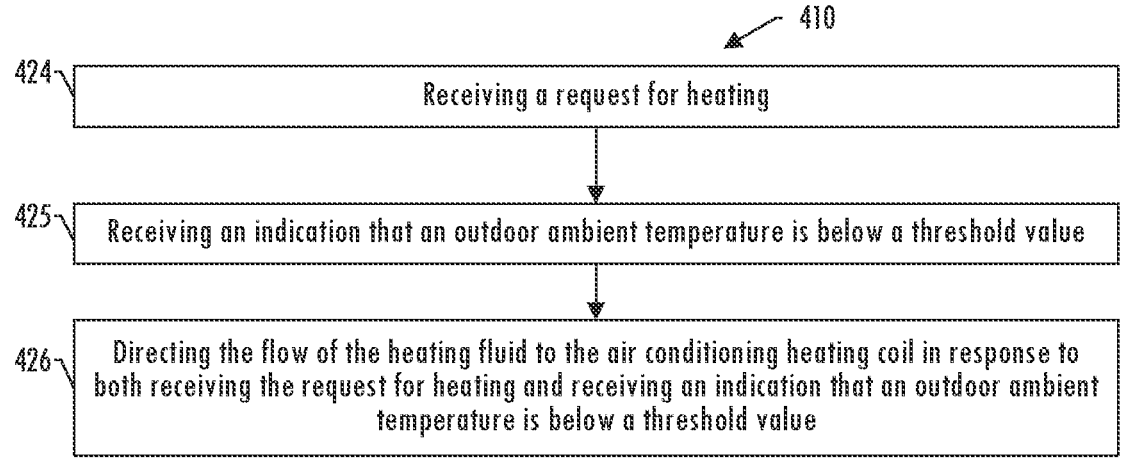

Turning now to FIG. 4E, in some examples, the step 410 may generally include step 424 and step 426 as shown.

Still with reference to FIG. 4E, the step 410 may further include receiving a request for heating, e.g., heating capacity with or without heating capacity from the primary indoor heat exchanger of the climate control system, as shown at step 424. In some examples, the step 424 may further include receiving, at the control circuitry, a request indication representative of a request for heating. In some examples, the step 424 may further include transmitting, from the air handling unit and/or other component of a climate control system, a request indication representative of a request for heating.

Still with reference to FIG. 4E, the step 410 may further include receiving an indication that an outdoor ambient temperature is below a threshold value, as shown at step 425. In some examples, the step 425 may further include receiving, at the control circuitry, a temperature indication representative of an outdoor ambient temperature. In some examples, the step 425 may further include transmitting, from a temperature sensor of the outdoor unit and/or other component of a climate control system, a temperature indication representative of an outdoor ambient temperature. In some examples, the step 425 may further include determining that the outdoor ambient temperature is above or below a predefined temperature threshold value. In some examples, the step 425 may further include transmitting, from the outdoor unit and/or other component of a climate control system, an indication representative of a determination that an outdoor ambient temperature is below the predefined temperature threshold value.

Still with reference to FIG. 4E, the step 410 may further include directing the flow of the heating fluid to the air conditioning heating coil in response to both receiving the request for heating and receiving an indication that an outdoor ambient temperature is below a threshold value, as shown at step 426. In some examples, the step 426 may further include switching the flow of the heating fluid from the hot water heater to the air conditioning heating coil. In some examples, the step 426 may further include transmitting, to one or more control valves, a direction indication representative of a command to switch the position of a control valve, e.g., from a first flow direction position to a second flow direction position. In some examples, the step 426 may further include one or more processes described for step 406.

Figure 4F:
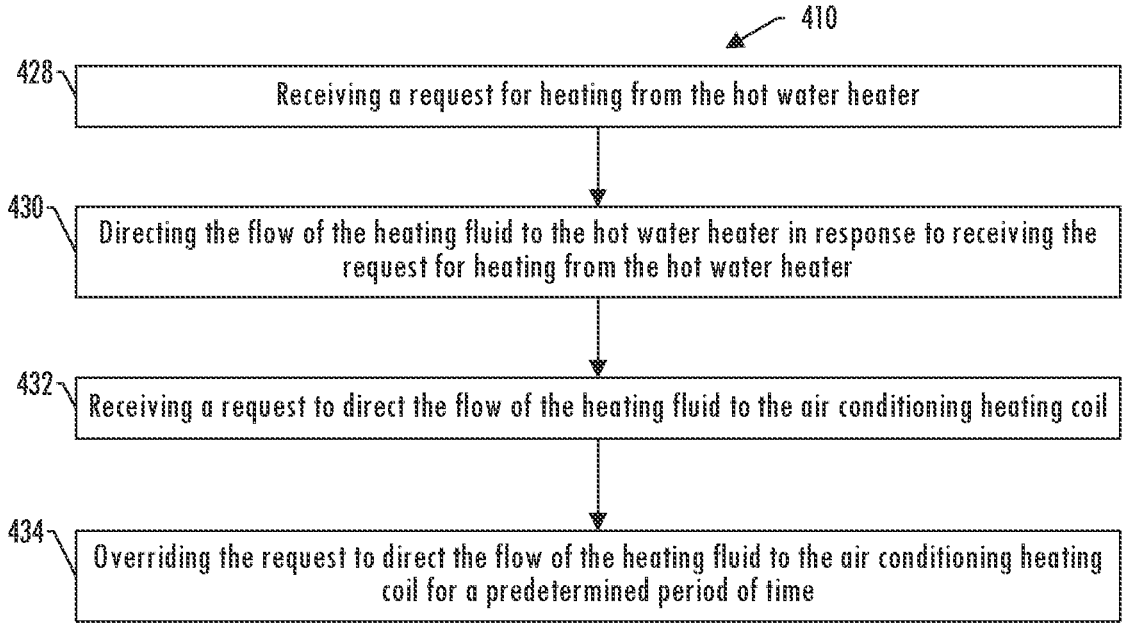

Turning now to FIG. 4F, in some examples, the step 410 may generally include step 428, step 430, step 432, and step 434 as shown.

Still with reference to FIG. 4F, the step 410 may further include receiving a request for heating from the hot water heater, as shown at step 428. In some examples, the step 428 may include receiving, at the control circuitry, a request indication representative of a request for heating from the hot water heater. In some examples, the step 428 may further include transmitting, from the hot water heater and/or component thereof, a request indication representative of a request for heating from the hot water heater.

Still with reference to FIG. 4F, the step 410 may further include directing the flow of the heating fluid to the hot water heater in response to receiving the request for heating from the hot water heater, as shown at step 430. In some examples, the step 430 may include directing the flow of the heating fluid to a hot water heat exchanger of the hot water heater, e.g., hot water heating coil, water tank heating coil, tubular heat exchanger, or the like. In some examples, the step 430 may further include switching the flow of the heating fluid from the air conditioning heating coil to the hot water heater. In some examples, the step 430 may further include transmitting, to one or more control valves, a direction indication representative of a command to switch the position of the control valve, e.g., from a first flow direction position to a second flow direction position. In some examples, the step 430 may further include one or more processes described for step 408.

Still with reference to FIG. 4F, the step 410 may further include receiving a request to direct the flow of the heating fluid to the air conditioning heating coil, as shown at step 432. In some examples, the step 432 may further include receiving, at the control circuitry, a request indication representative of a request to direct the flow of the heating fluid to the air conditioning heating coil. In some examples, the step 432 may further include transmitting, from the air handling unit and/or other component of a climate control system, a request indication representative of a request to direct the flow of the heating fluid to the air conditioning heating coil.

Still with reference to FIG. 4F, the step 410 may further include overriding the request to direct the flow of the heating fluid to the air conditioning heating coil for a predetermined period of time, as shown at step 434. In some examples, the step 434 may further include starting, at the control circuitry, a timer for a predetermined period of time to determine when the flow of the heating fluid may be directed to the air conditioning heating coil. In some examples, the timer may be an elapse timer. In some examples, the step 434 may further include automatically directing the flow of the heating fluid to the air conditioning heating coil based, at least in part, on a determination that the predetermined period of time has ended. In some examples, the step 434 may further include not directing the flow of the heating fluid to the air conditioning heating coil until, at least in part, another request to direct the flow of the heating fluid to the air conditioning heating coil is received, e.g., from the climate control system at the control circuitry.

Figure 4G:
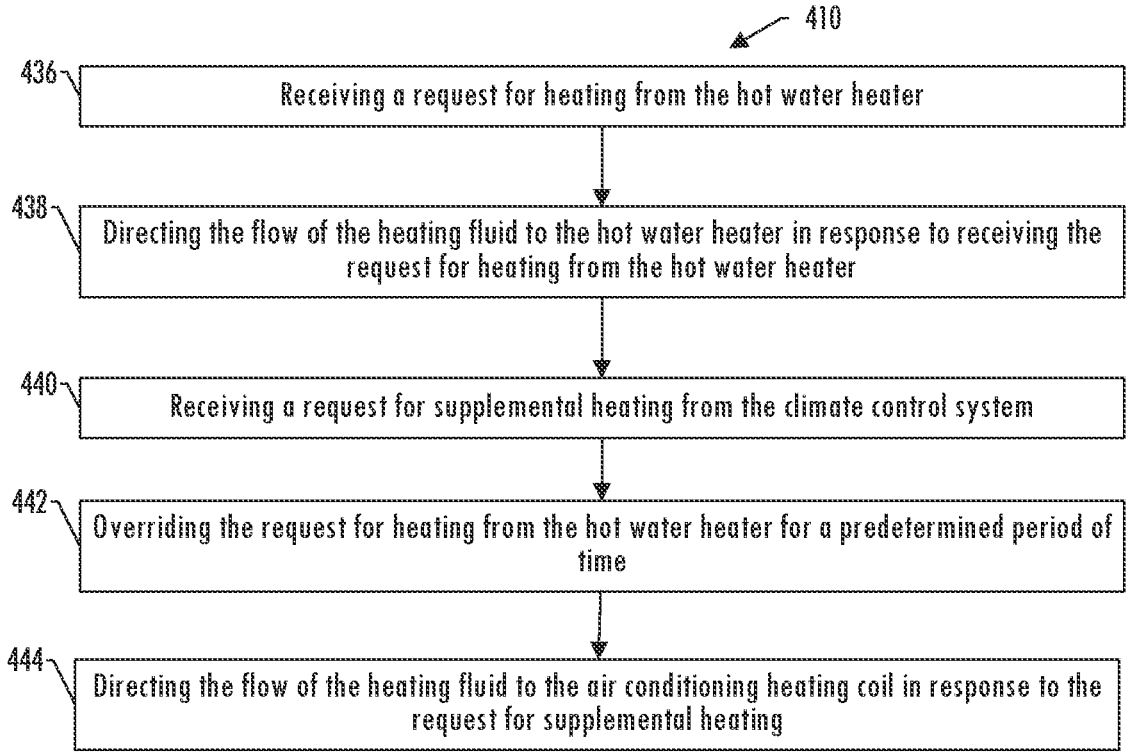

Turning now to FIG. 4G, in some examples, the step 410 may generally include step 436, step 438, step 440, step 442 and step 444 as shown.

Still with reference to FIG. 4G, the step 410 may further include receiving a request for heating from the hot water heater, as shown at step 436. In some examples, the step 436 may include receiving, at the control circuitry, a request indication representative of a request for heating from the hot water heater. In some examples, the step 436 may further include transmitting, from the hot water heater and/or component thereof, a request indication representative of a request for heating from the hot water heater.

Still with reference to FIG. 4G, the step 410 may further include directing the flow of the heating fluid to the hot water heater in response to receiving the request for heating from the hot water heater, as shown at step 438. In some examples, the step 430 may include directing the flow of the heating fluid to a hot water heat exchanger of the hot water heater, e.g., water tank heating coil, tubular heat exchanger, or the like. In some examples, the step 438 may further include switching the flow of the heating fluid from the air conditioning heating coil to the hot water heater. In some examples, the step 438 may further include transmitting, to one or more control valves, a direction indication representative of a command to switch the position of the control valve, e.g., from a first flow direction position to a second flow direction position. In some examples, the step 438 may further include one or more processes described for step 408.

Still with reference to FIG. 4G, the step 410 may further include receiving a request for supplemental heating from the climate control system, as shown at step 440. In some examples, the step 440 may further include receiving, at the control circuitry, a request indication representative of a request for supplemental heating. In some examples, the step 440 may further include transmitting, from the air handling unit and/or other component of a climate control system, a request indication representative of a request for supplemental heating. In some examples, the step 440 may further include one or more processes described for step 408.

Still with reference to FIG. 4G, the step 410 may further include overriding the request for heating from the hot water heater for a predetermined period of time, as shown at step 442. In some examples, the overriding the request for heating from the hot water heater for a predetermined period of time, as shown at step 442, may be based, at least in part, on receipt of the request for supplemental heating In some examples, the step 442 may further include starting, at the control circuitry, a timer for a predetermined period of time to determine when to stop overriding the request for heating from the hot water heater. In some examples, the timer may be an elapse timer. In some examples, the step 442 may further include automatically directing the flow of the heating fluid to the hot water heater based, at least in part, on a determination that the predetermined period of time has ended. In some examples, the step 442 may further include not directing the flow of the heating fluid to the hot water heater until, at least in part, another request for heating from the hot water heater is received, e.g., from the hot water heater at the control circuitry.

Still with reference to FIG. 4G, the step 410 may further include directing the flow of the heating fluid to the air conditioning heating coil in response to a request for supplemental heating, as shown at step 444. In some examples, the step 444 may further include switching the flow of the heating fluid from the hot water heater to the air conditioning heating coil. In some examples, the step 444 may further include transmitting, to one or more control valves, a direction indication representative of a command to switch the position of a control valve, e.g., from a first flow direction position to a second flow direction position. In some examples, the step 444 may further include one or more processes described for step 406.

FIG. 5 shows a schematic diagram for at least an example climate control system 500, which may be included, in whole or in part, in the heating system 100 discussed above. In some examples, the climate control system 500 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The examples depicted in FIG. 5 are configured in a cooling mode. The climate control system 500, in some examples is configured as a split system heat pump system, and generally comprises an indoor unit 502, an outdoor unit 504, and a system controller 506 that may generally control operation of the indoor unit 502 and/or the outdoor unit 504. The indoor unit 502 and the outdoor unit 504 may be fluidly coupled via the refrigerant fluid circuit 534. In the depicted example, the climate control system also includes an additional supplemental heat exchanger 540. In this example, supplemental heat exchanger 540 may be the same or substantially the same as the absorption heat exchanger 110 discussed above in connection with FIG. 1.

Indoor unit 502 generally comprises an indoor air handling unit comprising an indoor heat exchanger 508, an indoor fan 510, an indoor metering device 512, and an indoor controller 524. The indoor heat exchanger 508 may generally be configured to promote heat exchange between a refrigerant fluid carried within internal tubing of the indoor heat exchanger 508 and an airflow that may contact the indoor heat exchanger 508 but that is segregated from the refrigerant fluid. Indoor unit 502 may at least partially include, or be coupled to, a duct system 532 including one or more of an air return duct, a supply duct, a register, a vent, a damper, an air filter, or the like for providing airflow.

The indoor metering device 512 may generally comprise an electronically-controlled motor-driven electronic expansion valve (EEV). In some examples, however, the indoor metering device 512 may comprise a thermostatic expansion valve, a capillary tube assembly, and/or any other suitable metering device.

Outdoor unit 504 generally comprises an outdoor heat exchanger 514, a compressor 516, an outdoor fan 518, an outdoor metering device 520, a switch over valve 522, and an outdoor controller 526. The compressor 516 may be any type of compressor, including a compressor the same or similar to compressors discussed above. The outdoor heat exchanger 514 may generally be configured to promote heat transfer between a refrigerant fluid carried within internal passages of the outdoor heat exchanger 514 and an airflow that contacts the outdoor heat exchanger 514 but is segregated from the refrigerant fluid.

In the depicted example, the outdoor unit 504 also includes a supplemental heat exchanger 540, which may be coupled to a Stirling heat pump as discussed above in connection with FIG. 1. For example, supplemental heat exchanger 540 may be an absorption heat exchanger, similar to absorption heat exchanger 110 discussed above. Further, heat exchanger 540 may be thermally connected with a Stirling heat pump via a fluid, e.g., a heat absorption fluid. In the example depicted in FIG. 5 only connections 542 are shown, but it is understood that additional components may be connected as discussed above in FIG. 1. Further, in the example depicted in FIG. 5, the supplemental heat exchanger 540 may be located within the outdoor unit 504, which may be advantageous for packaging and other reasons. In addition, the outdoor fan 518 may be arranged such that it directs airflow over heat exchanger 540 to further promote heat transfer between a fluid flowing through heat exchanger 540 and the airflow. In some examples, this heat transfer may be done in a similar manner as discussed above in connection with FIG. 1. Further, the depicted example provided in FIG. 5 shows heat exchanger 540 in series with outdoor heat exchanger 514 with respect to the airflow provided by outdoor fan 518. It is understood, however, that other arrangements may be utilized, e.g., these heat exchangers may be in parallel, multiple outdoor fans may be used, etc.

The outdoor metering device 520 may generally comprise a thermostatic expansion valve. In some examples, however, the outdoor metering device 520 may comprise an electronically-controlled motor driven EEV similar to indoor metering device 512, a capillary tube assembly, and/or any other suitable metering device.

In some examples, the switch over valve 522 may generally comprise a four-way reversing valve. The switch over valve 522 may also comprise an electrical solenoid, relay, and/or other device configured to selectively move a component of the switch over valve 522 between operational positions to alter the flow path of refrigerant fluid through the switch over valve 522 and consequently the climate control system 500. Additionally, the switch over valve 522 may also be selectively controlled by the system controller 506, an outdoor controller 526, and/or the indoor controller 524.

The system controller 506 may generally be configured to selectively communicate with the indoor controller 524 of the indoor unit 502, the outdoor controller 526 of the outdoor unit 504, and/or other components of the climate control system 500. In some examples, the system controller 506 may be configured to control operation of the indoor unit 502, and/or the outdoor unit 504. In some examples, the system controller 506 may be configured to monitor and/or communicate with a plurality of temperature and pressure sensors associated with components of the indoor 502, the outdoor unit 504, and/or the outdoor ambient environment. In some examples, the indoor unit 502 includes at least partially an indoor air handling unit.

Additionally, in some examples, the system controller 506 may comprise a temperature sensor and/or may further be configured to control heating and/or cooling of conditioned spaces or zones associated with the climate control system 500. In some examples, the system controller 506 may be configured as a thermostat for controlling the supply of conditioned air to zones associated with the climate control system 500, and in some examples, the thermostat includes a temperature sensor.

The system controller 506 may also generally comprise an input/output (I/O) unit (e.g., a graphical user interface, a touchscreen interface, or the like) for displaying information and for receiving user inputs. The system controller 506 may display information related to the operation of the climate control system 500 and may receive user inputs related to operation of the climate control system 500. However, the system controller 506 may further be operable to display information and receive user inputs tangentially related and/or unrelated to operation of the climate control system 500. In some examples, the system controller 506 may not comprise a display and may derive all information from inputs that come from remote sensors and remote configuration tools.

In some examples, the system controller 506 may be configured for selective bidirectional communication over a communication bus 528, which may utilize any type of communication network. For example, the communication may be via wired or wireless data links directly or across one or more networks, such as a control network. Examples of suitable communication protocols for the control network include CAN, TCP/IP, BACnet, LonTalk, Modbus, ZigBee, Zwave, Wi-Fi, SIMPLE, Bluetooth, and the like.

The indoor controller 524 may be carried by the indoor unit 502 and may generally be configured to receive information inputs, transmit information outputs, and/or otherwise communicate with the system controller 506, the outdoor controller 526, and/or any other device 530 via the communication bus 528 and/or any other suitable medium of communication. In some examples, the device 530 may include some or all of the systems described by the present disclosure. For example, the device 530 may be a sensor, or the like, as described by the present disclosure. In some examples, the device 530 may be housed within at least a unit (e.g., 502, 504, etc.) of the climate control system 500 and/or coupled thereto. In some examples, the device 530 may be a plurality of devices, each device 530 being associated with one or more units of the climate control system 500.

The outdoor controller 526 may be carried by the outdoor unit 504 and may be configured to receive information inputs from the system controller 506, which may be a thermostat. In some examples, the outdoor controller 526 may be configured to receive information related to an ambient temperature associated with the outdoor unit 504, information related to a temperature of the outdoor heat exchanger 514, and/or information related to refrigerant temperatures and/or pressures of refrigerant entering, exiting, and/or within the outdoor heat exchanger 514 and/or the compressor 516.

FIG. 6 illustrates the control circuitry 600, which may be an apparatus, according to some examples of the present disclosure. In some examples the control circuitry 600 includes some or all of the system controller 506, the indoor controller 524, the outdoor controller 526, or any other similar apparatus as described by the present disclosure. In some examples, the control circuitry 600 may include one or more of each of a number of components such as, for example, a processor 602 connected to a memory 604. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 602 may be a number of processors, a multi-core processor or some other type of processor, depending on the particular example.

The processor 602 may be configured to execute computer programs such as computer-readable program code 606, which may be stored onboard the processor or otherwise stored in the memory 604. In some examples, the processor may be embodied as, or otherwise include, one or more ASICs, FPGAs or the like. Thus, although the processor may be capable of executing a computer program to perform one or more functions, the processor of various examples may be capable of performing one or more functions without the aid of a computer program.

The memory 604 is generally any piece of computer hardware capable of storing information such as, for example, data, computer-readable program code 606 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 602, causes the control circuitry 600 to perform various operations as described herein, some of which may in turn cause the climate control system to perform various operations.

In addition to the memory 604, the processor 602 may also be connected to one or more peripherals such as a network adapter 608, one or more input/output (I/O) devices (e.g., input device(s) 610, output device(s) 612) or the like. The network adapter is a hardware component configured to connect the control circuitry 600 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A heating system for heating both conditioned air and water, the heating system comprising: a Stirling heat pump configured to provide heating to a heating fluid, the Stirling heat pump including a hot side chamber and a cold side chamber, the hot side chamber and the cold side chamber fluidly connected by a working fluid; and a heating fluid circuit thermally coupled to the hot side chamber and configured to circulate the heating fluid, the heating fluid circuit including: a circulation pump coupled to the heating fluid circuit and configured to circulate the heating fluid through the heating fluid circuit; an air conditioning heating coil, the air conditioning heating coil configured to heat the conditioned air circulated through an air handling unit; a hot water heating coil, the hot water heating coil configured to heat the water within a hot water heater; and a control valve coupled to the heating fluid circuit, the control valve configured to adjust a flow of the heating fluid between the air conditioning heating coil and the hot water heating coil.

Clause 2. The heating system in any of the clauses, further comprising a heat absorption circuit thermally coupled to the cold side chamber and configured to circulate a heat absorption fluid, the heat absorption circuit including: an absorption fluid circulation pump coupled to the heat absorption circuit and configured to circulate the heat absorption fluid through the heat absorption circuit; and an absorption heat exchanger coil, the absorption heat exchanger coil configured to exchange thermal energy between the heat absorption fluid and an outdoor ambient environment.

Clause 3. The heating system in any of the clauses, wherein the absorption heat exchanger coil is located within a housing of an outdoor unit of a climate control system, wherein the outdoor unit includes an outdoor heat exchanger within the housing, the outdoor heat exchanger configured to exchange thermal energy between a refrigerant fluid and the outdoor ambient environment.

Clause 4. The heating system in any of the clauses, wherein the outdoor unit further includes an outdoor fan, the outdoor fan configured to circulate outdoor ambient air over both the outdoor heat exchanger and the absorption heat exchanger coil.

Clause 5. The heating system in any of the clauses, wherein the air conditioning heating coil is located within a housing of the air handling unit, wherein the air handling unit further includes an indoor heat exchanger within the housing, the indoor heat exchanger configured to simultaneously exchange thermal energy between a refrigerant fluid and the conditioned air.

Clause 6. The heating system in any of the clauses, further including control circuitry, the control circuitry communicatively coupled to the control valve and configured to: adjust the flow of the heating fluid to the air handling unit based on a request for conditioning from the air handling unit.

Clause 7. The heating system in any of the clauses, wherein the request for conditioning is a request for supplemental heating, and wherein the control circuitry configured to adjust the flow of the heating fluid further includes directing the flow of the heating fluid to the air handling unit in response to the request for supplemental heating and a determination that a flow of a refrigerant fluid is already directed to the air handling unit in response to a request for heating.

Clause 8. The heating system in any of the clauses, wherein the request for conditioning is a request for heating, and wherein the control circuitry configured to adjust the flow of heating fluid is further configured to direct the flow of the heating fluid to the air conditioning heating coil in response to receiving the request for heating.

Clause 9. The heating system in any of the clauses, wherein the request for conditioning is a request for heating, and wherein the control circuitry configured to adjust the flow of heating fluid is further configured to direct the flow of the heating fluid to the air conditioning heating coil in response to both receiving the request for heating and receiving an indication that an outdoor ambient temperature is below a threshold value.

Clause 10. The heating system in any of the clauses, further including control circuitry, the control circuitry communicatively coupled to the control valve and configured to: direct the flow of the heating fluid to the hot water heating coil in response to receiving a request for heating from the hot water heater.

Clause 11. The heating system in any of the clauses, further including control circuitry, the control circuitry communicatively coupled to the control valve and configured to: direct the flow of the heating fluid to the hot water heating coil in response to receiving a request for heating from the hot water heater, wherein the control circuitry configured to direct the flow of the heating fluid to the hot water heating coil is further configured to override a request to direct the flow of the heating fluid to the air conditioning heating coil, wherein overriding the request lasts a predetermined period of time.

Clause 12. The heating system in any of the clauses, further including control circuitry, the control circuitry communicatively coupled to the control valve and configured to: direct the flow of the heating fluid to the hot water heating coil in response to receiving a request for heating from the hot water heater, wherein the control circuitry is further configured to direct the flow of the heating fluid to the air conditioning heating coil in response to a request for supplemental heating, wherein the request for supplemental heating overrides the request for heating from the hot water heater.

Clause 13. The heating system in any of the clauses, wherein the hot water heating coil provides a primary heat source to the hot water heater, and wherein another heat source of the hot water heater is, at least in part, suppressed while the hot water heating coil provides the primary heat source to the hot water heater.

Clause 14. An air handler unit thermally coupled to a water heater, the air handler unit including: a primary indoor coil, the primary indoor coil configured to exchange thermal energy between a refrigerant fluid and a conditioned air; a secondary air conditioning heating coil, the secondary air conditioning heating coil configured to exchange thermal energy between a heating fluid and the conditioned air, wherein the heating fluid is routed through a heating fluid circuit that includes a control valve, wherein the heating fluid circuit is thermally coupled to a hot side chamber of a Stirling heat pump, the Stirling heat pump including the hot side chamber, a cold side chamber, and a working fluid fluidly connected between the hot side chamber and the cold side chamber; a fan configured to circulate the conditioned air over the primary indoor coil and the secondary air conditioning heating coil to condition the conditioned air; and control circuitry communicatively coupled to the control valve and configured to: direct the heating fluid through the secondary air conditioning heating coil in response to a request for heating.

Clause 15. The air handler unit in any of the clauses, wherein the request for heating is a request for supplemental heating.

Clause 16. The air handler unit in any of the clauses, wherein the control circuitry configured to direct a flow of the heating fluid to the secondary air conditioning heating coil is further configured to direct the flow of the heating fluid to the secondary air conditioning heating coil in response to both receiving the request for heating and receiving an indication that an outdoor ambient temperature is below a threshold value.

Clause 17. The air handler unit in any of the clauses, wherein the heating fluid circuit further includes a hot water heating coil located within a water heater, and wherein the heating fluid circuit is configured to circulate the heating fluid to transfer thermal energy from the hot water heating coil to heat the water within the hot water heater.

Clause 18. The air handler unit in any of the clauses, wherein the heating fluid circuit is further thermally coupled to a hot side chamber of the Stirling heat pump, and wherein the Stirling heat pump further includes the hot side chamber, a cold side chamber, and a working fluid fluidly connected between the hot side chamber and the cold side chamber.

Clause 19. A method of heating both conditioned air and water using a heating fluid, the method including: circulating the heating fluid through a heating fluid circuit; heating the heating fluid; routing the heating fluid to an air conditioning heating coil, the air conditioning heating coil configured to heat the conditioned air circulated through an air handling unit; routing the heating fluid to a hot water heating coil, the hot water heating coil configured to heat the water within a hot water heater; and adjusting a flow of the heating fluid between the air conditioning heating coil and the hot water heating coil.

Clause 20. The method in any of the clauses, wherein the heating fluid is heated at a hot side chamber of a Stirling heat pump, the Stirling heat pump including the hot side chamber, a cold side chamber, and a working fluid fluidly connected between the hot side chamber and the cold side chamber, and wherein adjusting the flow of the heating fluid further includes adjusting the flow of the heating fluid to the air handling unit based on a request for conditioning from the air handling unit.

Clause 21. The method in any of the clauses, wherein the request for conditioning is a request for supplemental heating, and wherein adjusting the flow of the heating fluid further includes directing the flow of heating fluid to the air handling unit in response to the request for supplemental heating.

Clause 22. The method in any of the clauses, wherein the request for conditioning is a request for heating, and wherein adjusting the flow of the heating fluid further includes directing the flow of the heating fluid to the air conditioning heating coil in response to receiving the request for heating.

Clause 23. The method in any of the clauses, wherein the request for conditioning is a request for heating, and wherein adjusting the flow of the heating fluid further includes directing the flow of the heating fluid to the air conditioning heating coil in response to both receiving the request for heating and receiving an indication that an outdoor ambient temperature is below a threshold value.

Clause 24. The method in any of the clauses, wherein adjusting the flow of the heating fluid further includes directing the flow of the heating fluid to the hot water heating coil in response to receiving a request for heating from the hot water heater.

Clause 25. The method in any of the clauses, wherein directing the flow of the heating fluid to the hot water heating coil further includes overriding a request to direct the flow of the heating fluid to the air conditioning heating coil, wherein overriding the request lasts a predetermined period of time.

Clause 26. The method in any of the clauses, wherein adjusting the flow of the heating fluid further includes: directing the flow of the heating fluid to the hot water heating coil in response to receiving a request for heating from the hot water heater, and directing the flow of the heating fluid to the air conditioning heating coil in response to a request for supplemental heating, wherein the request for supplemental heating overrides the request for heating from the hot water heater.

Many modifications, other embodiments, examples, or implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments, examples, or implementations disclosed and that modifications and other embodiments, examples, or implementations are intended to be included within the scope of the appended claims. Moreover, although the foregoing description and the associated figures describe embodiments, examples, or implementations in the context of certain example combinations of elements and/or functions, it should be appreciated that different combinations of elements and/or functions may be provided by alternative embodiments, examples, or implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heating system for heating both conditioned air and water, the heating system comprising:

a Stirling heat pump configured to provide heating to a heating fluid, the Stirling heat pump including a hot side chamber and a cold side chamber, the hot side chamber and the cold side chamber fluidly connected by a working fluid;

an air handling unit having a housing, the air handling unit comprising an indoor heat exchanger within the housing and configured to simultaneously exchange thermal energy between a refrigerant fluid and the conditioned air; and a heating fluid circuit thermally coupled to the hot side chamber and configured to circulate the heating fluid, the heating fluid circuit including:

a circulation pump coupled to the heating fluid circuit and configured to circulate the heating fluid through the heating fluid circuit;

an air conditioning heating coil in the housing of the air handling unit, the air conditioning heating coil configured to heat the conditioned air circulated through the air handling unit;

a hot water heating coil, the hot water heating coil configured to heat the water within a hot water heater; and a control valve coupled to the heating fluid circuit, the control valve configured to adjust a flow of the heating fluid from the circulation pump to the air conditioning heating coil and from the circulation pump to the hot water heating coil.

2. The heating system of claim 1, further comprising a heat absorption circuit thermally coupled to the cold side chamber and configured to circulate a heat absorption fluid, the heat absorption circuit including:

an absorption fluid circulation pump coupled to the heat absorption circuit and configured to circulate the heat absorption fluid through the heat absorption circuit; and an absorption heat exchanger coil, the absorption heat exchanger coil configured to exchange thermal energy between the heat absorption fluid and an outdoor ambient environment.

3. The heating system of claim 2, wherein the absorption heat exchanger coil is located within a housing of an outdoor unit of a climate control system, wherein the outdoor unit includes an outdoor heat exchanger within the housing, the outdoor heat exchanger configured to exchange thermal energy between a refrigerant fluid and the outdoor ambient environment.

4. The heating system of claim 3, wherein the outdoor unit further includes an outdoor fan, the outdoor fan configured to circulate outdoor ambient air over both the outdoor heat exchanger and the absorption heat exchanger coil.

5. The heating system of claim 1, further including control circuitry, the control circuitry communicatively coupled to the control valve and configured to:

adjust the flow of the heating fluid to the air handling unit based on a request for conditioning from the air handling unit.

6. The heating system of claim 5, wherein the request for conditioning is a request for supplemental heating, and wherein the control circuitry configured to adjust the flow of the heating fluid further includes directing the flow of the heating fluid to the air handling unit in response to the request for supplemental heating and a determination that a flow of the refrigerant fluid is already directed to the air handling unit in response to a request for heating.

7. The heating system of claim 5, wherein the request for conditioning is a request for heating, and wherein the control circuitry configured to adjust the flow of heating fluid is further configured to direct the flow of the heating fluid to the air conditioning heating coil in response to receiving the request for heating.

8. The heating system of claim 5, wherein the request for conditioning is a request for heating, and wherein the control circuitry configured to adjust the flow of heating fluid is further configured to direct the flow of the heating fluid to the air conditioning heating coil in response to both receiving the request for heating and receiving an indication that an outdoor ambient temperature is below a threshold value.

9. The heating system of claim 1, further including control circuitry, the control circuitry communicatively coupled to the control valve and configured to:

direct the flow of the heating fluid to the hot water heating coil in response to receiving a request for heating from the hot water heater, wherein the control circuitry configured to direct the flow of the heating fluid to the hot water heating coil is further configured to override a request to direct the flow of the heating fluid to the air conditioning heating coil, wherein overriding the request lasts a predetermined period of time.

10. The heating system of claim 1, further including control circuitry, the control circuitry communicatively coupled to the control valve and configured to:

direct the flow of the heating fluid to the hot water heating coil in response to receiving a request for heating from the hot water heater, wherein the control circuitry is further configured to direct the flow of the heating fluid to the air conditioning heating coil in response to a request for supplemental heating, wherein the request for supplemental heating overrides the request for heating from the hot water heater.

11. The heating system of claim 1, wherein the hot water heating coil provides a primary heat source to the hot water heater, and wherein another heat source of the hot water heater is, at least in part, suppressed while the hot water heating coil provides the primary heat source to the hot water heater.

12. An air handler unit, the air handler unit including:

a housing;

a primary indoor coil in the housing, the primary indoor coil configured to exchange thermal energy between a refrigerant fluid and a conditioned air;

a secondary air conditioning heating coil in the housing, the secondary air conditioning heating coil configured to exchange thermal energy between a heating fluid and the conditioned air, wherein the heating fluid is routed through a heating fluid circuit that includes a control valve, wherein the heating fluid circuit is thermally coupled to a hot side chamber of a Stirling heat pump, the Stirling heat pump including the hot side chamber, a cold side chamber, and a working fluid fluidly connected between the hot side chamber and the cold side chamber;

a fan configured to circulate the conditioned air over the primary indoor coil and the secondary air conditioning heating coil to condition the conditioned air; and control circuitry communicatively coupled to the control valve and configured to:

direct the heating fluid through the secondary air conditioning heating coil in response to a request for heating.

13. The air handler unit of claim 12, wherein the request for heating is a request for supplemental heating.

14. The air handler unit of claim 13, wherein the control circuitry configured to direct a flow of the heating fluid to the secondary air conditioning heating coil is further configured to direct the flow of the heating fluid to the secondary air conditioning heating coil in response to both receiving the request for heating and receiving an indication that an outdoor ambient temperature is below a threshold value.

15. A method of heating both conditioned air and water using a heating fluid, the method including:

circulating the heating fluid through a heating fluid circuit with a circulation pump;

heating the heating fluid;

routing the heating fluid to an air conditioning heating coil in the housing of an air handling unit holding an indoor heat exchanger configured to simultaneously exchange thermal energy between a refrigerant fluid and the conditioned air, the air conditioning heating coil configured to heat the conditioned air circulated through the air handling unit;

routing the heating fluid to a hot water heating coil, the hot water heating coil configured to heat the water within a hot water heater; and at least one of adjusting a flow of the heating fluid from the circulation pump to the air conditioning heating coil or adjusting a flow of the heating fluid from the circulation pump to the hot water heating coil.

16. The method of claim 15, wherein the heating fluid is heated at a hot side chamber of a Stirling heat pump, the Stirling heat pump including the hot side chamber, a cold side chamber, and a working fluid fluidly connected between the hot side chamber and the cold side chamber, and wherein adjusting the flow of the heating fluid from the circulation pump to the air conditioning heating coil further includes adjusting the flow of the heating fluid to the air handling unit based on a request for conditioning from the air handling unit.

17. The method of claim 16, wherein the request for conditioning is a request for supplemental heating, and wherein adjusting the flow of the heating fluid from the circulation pump to the air conditioning heating coil further includes directing the flow of heating fluid to the air handling unit in response to the request for supplemental heating.

18. The method of claim 16, wherein the request for conditioning is a request for heating, and wherein adjusting the flow of the heating fluid from the circulation pump to the air conditioning heating coil further includes directing the flow of the heating fluid from the circulation pump to the air conditioning heating coil in response to receiving the request for heating.

19. The method of claim 16, wherein the request for conditioning is a request for heating, and wherein adjusting the flow of the heating fluid from the circulation pump to the air conditioning heating coil further includes directing the flow of the heating fluid from the circulation pump to the air conditioning heating coil in response to both receiving the request for heating and receiving an indication that an outdoor ambient temperature is below a threshold value.

* * * * *